US010546564B2

(12) United States Patent
Keller

(10) Patent No.: US 10,546,564 B2
(45) **Date of Patent: *Jan. 28, 2020**

(54) MUSICAL INSTRUMENT STRUCTURES FOR PERMANENT INSTALLATION IN AN OUTDOOR ENVIRONMENT

(71) Applicant: Landscape Structures Inc., Delano, MN (US)

(72) Inventor: Thomas L. Keller, Delano, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/646,529

(22) Filed: Jul. 11, 2017

(65) Prior Publication Data

US 2017/0309261 A1 Oct. 26, 2017

Related U.S. Application Data

(63) Continuation of application No. 15/290,559, filed on Oct. 11, 2016, now Pat. No. 9,773,482.
(Continued)

(51) Int. Cl.
*G10D 13/00* (2006.01)
*G10D 13/02* (2006.01)
(Continued)

(52) U.S. Cl.
CPC ..... *G10D 13/026* (2013.01); *G10D 13/027* (2013.01); *G10D 13/028* (2013.01); *G10D 13/08* (2013.01); *G10G 5/005* (2013.01)

(58) Field of Classification Search
CPC ..... G10G 5/005
See application file for complete search history.

(56) References Cited

U.S. PATENT DOCUMENTS 564,174 A 9/1895 Menzenitauer
1,356,193 A 10/1920 Danly
(Continued)

FOREIGN PATENT DOCUMENTS

DE 3836279 C1 6/1990
EP 3363014 A1 8/2018
(Continued)

OTHER PUBLICATIONS

Percussion Play, "Outdoor Musical Instruments" First accessed Dec. 2014. 3 Pages.
(Continued)

*Primary Examiner* — Kimberly R Lockett
(74) *Attorney, Agent, or Firm* — Wesley W. Malherek; Kelly, Holt & Christenson PLLC

(57) ABSTRACT

A metallophone structure configured for permanent installation in an outdoor environment is provided. The metallophone structure comprises a mounting structure. The metallophone structure also comprises a set of tone producing devices each coupled to the mounting structure by a fastener, wherein each tone producing device is configured to, when actuated, produce a sound frequency. The tone producing device is coupled in a location, by the fastener, as to reduce the effect on the quality of sound produced. The metallophone structure also comprises a mallet cradle configured to receive a mallet. The mallet is configured to actuate one of the tone producing devices. The metallophone structure is configured to be weather resistant such that each tone producing device still produces the sound frequency after an outdoor exposure period.

20 Claims, 22 Drawing Sheets

Related U.S. Application Data

(60) Provisional application No. 62/241,978, filed on Oct. 15, 2015.

(51) Int. Cl.
*G10D 13/08* (2006.01)
*G10G 5/00* (2006.01)

(56) References Cited

U.S. PATENT DOCUMENTS

| | | | | | |
|---|---|---|---|---|---|
| 2,347,287 | A * | 4/1944 | Sas | G10D 13/08 84/403 |
| 2,966,089 | A | 12/1960 | Gercken | |
| 4,469,003 | A | 9/1984 | Phelps | |
| 4,796,009 | A | 1/1989 | Biersach | |
| 4,881,442 | A * | 11/1989 | Stevens | G10D 13/08 84/403 |
| 4,890,786 | A | 1/1990 | Oberhofer et al. | |
| 5,266,732 | A | 11/1993 | Suzuki | |
| 5,345,852 | A | 9/1994 | Takahashi et al. | |
| 6,025,549 | A | 2/2000 | Harris | |
| 6,150,594 | A | 11/2000 | Fiondella et al. | |
| 6,517,467 | B1 | 2/2003 | Sutton et al. | |
| 6,551,167 | B1 | 4/2003 | Duck | |
| 7,081,576 | B1 | 7/2006 | Daoud | |
| 7,534,949 | B1 * | 5/2009 | Estes | G10D 13/08 446/416 |
| 8,563,841 | B1 | 10/2013 | Good | |
| 8,647,165 | B1 | 2/2014 | Blackwood et al. | |
| 8,936,502 | B2 | 1/2015 | King | |
| 9,734,808 | B2 | 8/2017 | Keller et al. | |
| 9,773,482 | B2 | 9/2017 | Keller | |
| 9,818,384 | B2 | 11/2017 | Keller et al. | |
| 2003/0029302 | A1 | 2/2003 | Reed | |
| 2003/0047059 | A1 | 3/2003 | Brown, Jr. | |
| 2003/0126971 | A1 | 7/2003 | Rawlins | |
| 2004/0035742 | A1 | 2/2004 | Aesch | |
| 2005/0022648 | A1 | 2/2005 | Belli | |
| 2006/0000340 | A1 | 1/2006 | Barakat | |
| 2006/0236843 | A1 | 10/2006 | Becker-Ehmck | |
| 2006/0272478 | A1 | 12/2006 | Steinhour et al. | |
| 2007/0256532 | A1 | 11/2007 | Lu | |
| 2009/0013850 | A1 | 1/2009 | Abe | |
| 2010/0150359 | A1 | 6/2010 | Knickrehm et al. | |
| 2010/0282048 | A1 | 11/2010 | Hashimoto et al. | |
| 2014/0026736 | A1 | 1/2014 | Sato et al. | |
| 2014/0060285 | A1 | 3/2014 | Bradfield | |
| 2015/0000503 | A1 | 1/2015 | Fitzgerald | |
| 2015/0063621 | A1 | 3/2015 | Lilley, Jr. | |
| 2015/0187344 | A1 | 7/2015 | James | |
| 2015/0248877 | A1 | 9/2015 | Good | |
| 2016/0240175 | A1 | 8/2016 | Bedson | |
| 2016/0322036 | A1 | 11/2016 | Good | |
| 2017/0110099 | A1 | 4/2017 | Keller et al. | |
| 2017/0110100 | A1 | 4/2017 | Keller | |

FOREIGN PATENT DOCUMENTS

| | | | |
|---|---|---|---|
| GB | 2478324 | A | 9/2011 |
| JP | 05-075793 | U | 10/1993 |
| KR | 10-1506882 | B1 | 3/2015 |
| WO | 2017066379 | A1 | 4/2017 |

OTHER PUBLICATIONS

Acoustic Arts, "Playground Percussion 2013 Catalogue" Jun. 25, 2013. 8 Pages.

Sound Play, "Accessible Musical Playground Equipment," http://www.soundplay.com/metallophones.html, Mar. 9, 2010. 3 Page.

Freenotes, "Outdoor Musical Instruments 2015 Product Catalog," Jan. 1, 2015. 15 pages.

Grounds for Play, "Music Curricula—Outdoor music instruments for your commercial playground", http://www.groundsforplay.com, Feb. 2, 2011. 3 pages.

Issue Notification for U.S. Appl. No. 15/635,679 dated Oct. 25, 2017, 1 page.

International Search Report and Written Opinion for International Patent Application No. PCT/US2016/056741, dated Dec. 14, 2016, date of filing: Oct. 13, 2016, 17 pages.

International Search Report and Written Opinion for International Patent Application No. PCT/US2016/056735, dated Dec. 14, 2016, date of filing: Oct. 13, 2016, 15 pages.

Prosecution History for U.S. Appl. No. 15/292,274 including: Issue Notification dated Jul. 26, 2017, Supplemental Notice of Allowance dated Jul. 13, 2017, Drawings filed Jun. 26, 2017, Notice of Allowance dated Jun. 20, 2017, Amendment dated Apr. 25, 2017, Non-Final Office Action dated Apr. 7, 2017, and Application and Drawings filed Oct. 13, 2016, 61 pages.

"Fun and Colourful Conga Outdoor Drum—Playground Drums," Web page <http://percussionplay.com/congas/>, Mar. 30, 2015, retrieved from Internet Archive Wayback Machine <https://web.archive.org/web/20150330154835/http://percussionplay.com/congas/> on Apr. 2, 2017, 7 pages.

"Tuned Drum"—Freenotes Harmony Park Outdoor Musical Instruments, Web page <http://freenotesharmonypark.com/wp-content/uploads/2016/05/FHP-Tuned-Drums-Final.pdf>.

Prosecution History for U.S. Appl. No. 15/290,559 including: Issue Notification dated Sep. 6, 2017, Supplemental Notice of Allowance dated Aug. 23, 2017, Notice of Allowance dated Jul. 3, 2017, Amendment dated May 30, 2017, Non-Final Office Action dated May 19, 2017, Amendment dated Jan. 20, 2017, Non-Final Office Action dated Dec. 20, 2016 and Application and Drawings filed Oct. 11, 2016, 78 pages.

Percussion Play—"Installation Instructions", <http://percussionplay.com/content/downloads/installation/congas_installation.pdf> and <http://percussionplay.com/technical-information/>accessed on Aug. 6, 2017, 9 pages.

"Tuned Drum—Installation Guide", Freenotes Harmony Park Outdoor Musical Instruments<http://freenotesharmonypark.com/wp-content/uploads/2017/01/TunedDrums2017_InstallationGuide-REV-A.pdf>, <http://freenotesharmonypark.com/wp-content/uploads/2017/04/FHP-Tuned-Drums-Final-Up-Date-3-24-17.pdf>, accessed Aug. 6, 2017.

"Tuned Drum"—Freenotes Harmony Park Outdoor Musical Instruments, Web page <https://web.archive.org/web/20140222185036/http://freenotesharmonypark.com/products/instrument-collection/tuned-drums/>, retrieved on Aug. 7, 2017, 5 pages.

"Tuned Drum"—Freenotes Harmony Park Outdoor Musical Instruments, Web page <http://freenotesharmonypark.com/products/instrument-collection/tuned-drums, etrieved on Aug. 7, 2017, 3 pages.

Prosecution History for U.S. Appl. No. 15/635,679 including: Notice of Allowance dated Sep. 25, 2017, Amendment dated Aug. 22, 2017, Non-Final Office Action dated Aug. 11, 2017, Application and Drawings filed Jun. 28, 2017, 46 pages.

Application and Drawings for U.S. Appl. No. 15/782,102, filed Oct. 12, 2017, 25 pages.

EP Application No. 16856147.0 Supplemental European Search Report dated May 10, 2019, 10 pages.

EP Application No. 16856145.4 Extended European Search Report dated May 17, 2019, 10 pages.

Anonymous: Freenotes Harmony Park; Musical Instruments for a Variety of Outdoor Settings, Jan. 1, 2013, Retrieved from the Internet URL:http://www.allincclusivec.com/images/FreeNotes_Catalog.pdf, Retrieved on May 7, 2019, 25 pages.

Percussion Play: Outdoor Musical Instruments from Percussion Play, Dec. 18, 2014, Retrieved from the Internet URL:https://www.youtube.com/watch?v=0Fw4xjQBJ6Q, Retrieved May 19, 2019, 1 page.

Canadian Application No. 3,001,707 Office Action dated Jan. 16, 2019, 3 pages.

Canadian Application No. 3,001,700 Office Action dated Jan. 23, 2019, 3 pages.

(56) References Cited

OTHER PUBLICATIONS

International Preliminary Report on Patentability, Application No. PCT/US2016/056741, dated Apr. 26, 2018, 12 pages.

* cited by examiner

310

| Note | Bar Length |
|---|---|
| Low C | 19 1/2" |
| Low D | 18 1/2" |
| Low E | 17 1/2" |
| Low F | 17" |
| Low G | 15 15/16" |
| Low A | 15 1/8" |
| Low B | 14 1/8" |
| Middle C | 13 13/16" |
| High D | 13" |
| High E | 12 3/16" |
| High F | 11 13/16" |
| High G | 11 1/8" |
| High A | 10 5/8" |
| High B | 10" |
| High C | 9 5/8" |

302

310

| Note | Tube Length |
|---|---|
| Low C | 32 5/8" |
| Low D | 30 11/16" |
| Low E | 29" |
| Low F | 28 3/16" |
| Low G | 26 5/8" |
| Low A | 25 1/8" |
| Low B | 23 11/16" |
| Middle C | 23" |
| High D | 21 11/16" |
| High E | 20 1/2" |
| High F | 19 13/16" |
| High G | 18 11/16" |
| High A | 17 5/8" |
| High B | 16 5/8" |
| High C | 16 3/16" |

304

310

| Note | Tube Length |
|---|---|
| Low C | 51 1/2" |
| Low D | 48 1/2" |
| Low E | 45 13/16" |
| Low F | 45 1/2" |
| Low G | 42" |
| Low A | 39 5/8" |
| Low B | 37 3/16" |
| Middle C | 36 3/16" |
| High D | 34 3/16" |
| High E | 32 3/16" |
| High F | 31 1/8" |
| High G | 29 5/16" |
| High A | 27 1/2" |
| High B | 26" |
| High C | 25 1/8" |

306

300

FIG. 3

MUSICAL INSTRUMENT STRUCTURES FOR PERMANENT INSTALLATION IN AN OUTDOOR ENVIRONMENT

CROSS-REFERENCE TO RELATED APPLICATIONS

The present application is based on and claims the benefit of U.S. patent application Ser. No. 15/290,559, filed Oct. 11, 2016 which is based on and claims the benefit of Provisional Patent Application Ser. No. 62/241,978 filed Oct. 15, 2015, the content of which is hereby incorporated by reference in its entirety.

BACKGROUND

Research has found that learning and playing music facilitates learning other subjects and enhances skills that children inevitably use in other areas. Childhood is the time when children learn about their world, primarily through play. If a play environment contains sufficiently rich musical elements, there will be a continuous exposure to new musical elements followed by the child's playful experimentation and learning.

SUMMARY

A metallophone structure configured for permanent installation in an outdoor environment is provided. The metallophone structure comprises a mounting structure. The metallophone structure also comprises a set of tone producing devices each coupled to the mounting structure by a fastener, wherein each tone producing device is configured to, when actuated, produce a sound frequency. The tone producing device is coupled in a location, by the fastener, as to reduce the effect on the quality of sound produced. The metallophone structure also comprises a mallet cradle configured to receive a mallet. The mallet is configured to actuate one of the tone producing devices. The metallophone structure is configured to be weather resistant such that each tone producing device still produces the sound frequency after an outdoor exposure period.

These and various other features and advantages that characterize the claimed embodiments will become apparent upon reading the following detailed description and upon reviewing the associated drawings.

BRIEF DESCRIPTION OF THE DRAWINGS

FIG. 3 illustrates some example specifications for a tone bar set in accordance with one embodiment of the present invention.

DETAILED DESCRIPTION OF ILLUSTRATIVE EMBODIMENTS

The present disclosure relates to outdoor musical instrument structures that are sustainable, durable and allow a user to produce robust and true sound. Musical instruments can produce sound through a variety of mechanisms, depending on the type of instrument and sound desired. For example, drums, guitars, and trumpets all allow a user to produce sound through different mechanisms. However, many instruments are not easily optimized for prolonged use in an outdoor recreational environment. In addition, instruments that are designed for sustainability often lack the configuration and proper composition that allow the user to produce robust sound. One solution is to create outdoor musical instrument structures optimized for outdoor recreation areas, such as playgrounds and parks, while allowing a user to produce robust sound. Another important consideration for outdoor musical instrument structures is the ability for all interested users to engage the structures. For example, at least some embodiments described herein may be configured to allow for play by users of all heights and abilities. For example, in some embodiments, the instruments are configured to allow for increased accessibility for users in a wheelchair.

Providing an outdoor musical instrument presents many logistical challenges. The outdoor environment presents temperatures at both hot and cold extremes. Further, an outdoor musical instrument is also exposed to weather—wind, rain and particulates. Additionally, maintaining consistent tuning is also a problem. Also, there are theft prevention concerns, requiring that no part of the instrument is easily removed, without inhibiting use. For at least these reasons, musical instruments require significant design for outdoor use, and cannot merely be transferred from an indoor environment to an outdoor environment. Additionally, there are vandalism concerns. While indoor instruments are typically used under supervision, outdoor musical instruments may be used in areas with little or no supervision at all. Therefore, it is important that outdoor musical instruments be constructed to withstand vandalism.

Also a playground environment has unique considerations that other environments lack. Playgrounds have minimal supervision, whereas an indoor musical instrument is normally operated under supervision of a teacher and a child only uses it alone after professional training. Playgrounds ideally have infrequent (or no regular) repairs, whereas an indoor musical instrument is fragile and requires regular repair and cleaning.

Figure 1A:
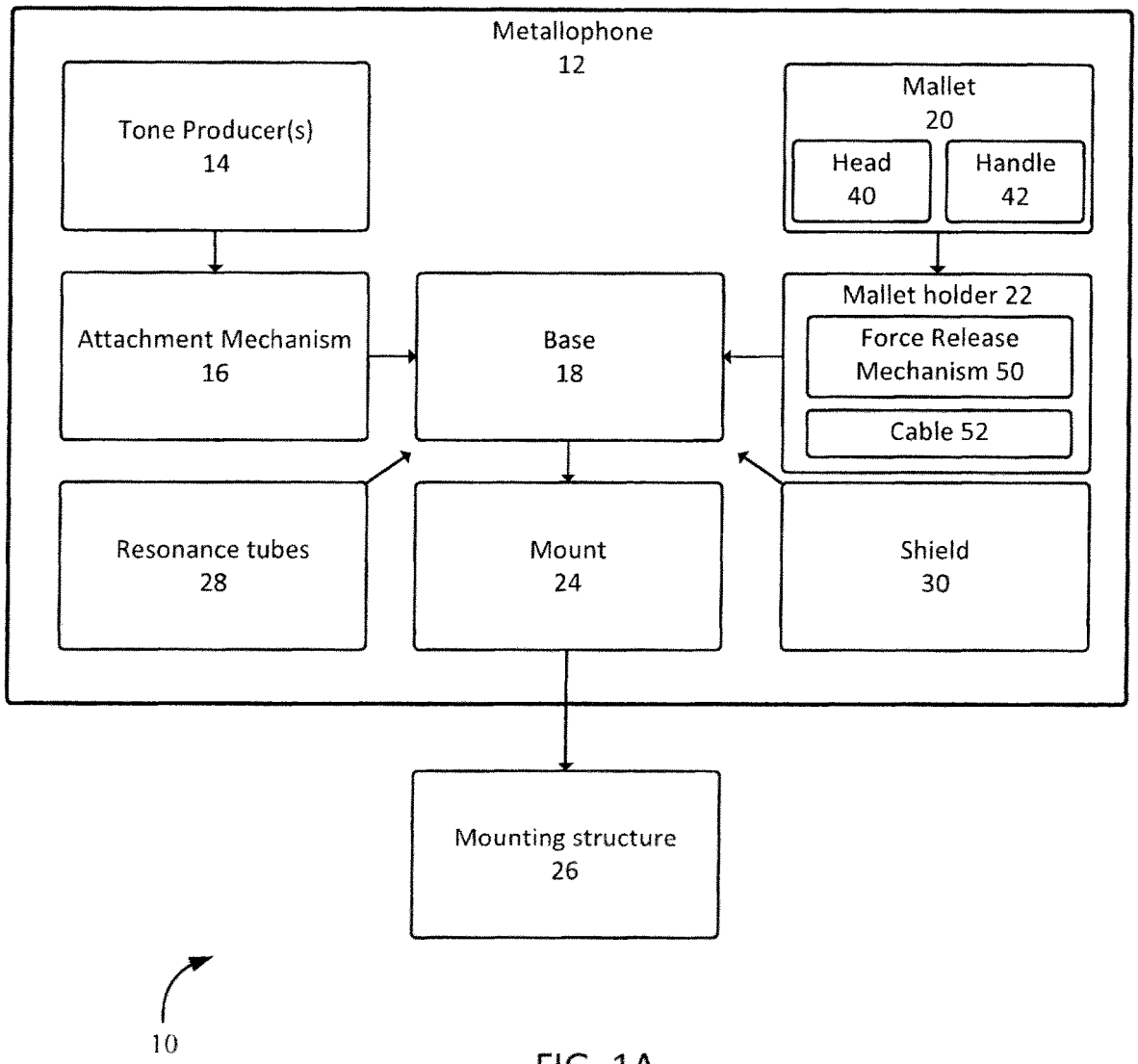
FIG. 1A illustrates a block diagram of a metallophone in accordance with one embodiment of the present invention.

FIG. 1A illustrates a block diagram of a metallophone in accordance with one embodiment of the present invention. For the sake of simplicity, but not by limitation, the term metallophone is used herein. Metallophone refers to bars/tubes of metal. However, any instrument in the idiophone family is also envisioned for at least some embodiments described herein. Metallophone installation 10, in the embodiment of FIG. 1A comprises a metallophone 12 and mounting structure 26. Metallophone 12, in the embodiment of FIG. 1A, comprises a tone producer 14, attachment mechanism 16, base 18, mallet 20, mallet holder 22, mount 24, resonance structure 28 and shield 30. In some embodiments, at least some components of metallophone 12 are manufactured separately. In some embodiments, two or more components may be manufactured as a single component. In at least some embodiments, a single component may provide the function of multiple components.

Tone producer 14 is configured to generate sound when actuated, for example by striking. Tone producer 14 comprises metal, in one embodiment. In another embodiment, tone producer 14 comprises a composite. In one embodiment, tone producer 14 comprises fiberglass. In one embodiment, tone producer 14 comprises wood. In one embodiment, tone producer 14 comprises plastic. Tone producer 14, in one embodiment, is a tone bar. In one embodiment, tone producer 14 is at least partially hollow. In another embodiment, tone producer 14 is substantially solid. Tone producer 14, in one embodiment, is a tubular bell. In other embodiments, tone producer 14 comprises a different idiophone component. In one embodiment, metallophone 12 comprises a resonance structure 28. Resonance structure 28 may provide an improvement in the sound produced by tone producer 14. In one embodiment resonance structure 28 is a plurality of resonance tubes.

Attachment mechanism 16 couples tone producer 14 to base 18. Attachment mechanism 16, in one embodiment, is configured to provide protection against theft/removal of tone producer 14, with substantially no effect on the sound produced by tone producer 14. In one embodiment, attachment mechanism 16 is configured to allow for substantially free vibration of tone producer 14. Attachment mechanism 16, in one embodiment, comprises a bolt. In one embodiment, attachment mechanism 16 comprises a component 500, discussed in greater detail with respect to FIG. 5. In one embodiment, attachment mechanism 16 comprises a pin. Attachment mechanism 16, in one embodiment, comprises an anti-theft fastener. In one embodiment, attachment mechanism 16 comprises a physical bonding, for example, welding. Attachment mechanism 16, in other embodiments, may comprise any of the following: a U-bolt, a wire rope clamp, a conduit strap, a threaded block, or any other suitable mechanism. In one embodiment, attachment mechanism 16 comprises material that is substantially weatherproof and configured to withstand outdoor conditions without changing the sound produced by tone producer 14.

Mallet 20 is one example of an actuation mechanism for tone producer 14. In the embodiment of FIG. 1A, mallet 20 comprises head 40 and handle 42. In one embodiment, head 40 comprises plastic. In one embodiment, head 40 comprises polyurethane. En one embodiment, head 40 comprises rubber. In one embodiment, handle 42 comprises metal. In one embodiment, handle 42 comprises aluminum. In one embodiment, handle 42 comprises fiberglass. Metallophone 12, in one embodiment, may comprise a shield 30. Shield 30 may provide protection for mallet 20 and/or attachment mechanism 16. In one embodiment, shield 30 comprises plastic. In another embodiment, shield 30 comprises a soft durable material.

Mallet holder 22, in one embodiment, is configured to couple mallet 20 to base 18. Mallet holder 22 may provide protection against theft/removal of mallet 20. Mallet holder 22, in one embodiment, comprises a cable 24 coupled to both mallet 20 and base 18. Cable 52 of mallet holder 22, in one embodiment, comprises a stainless steel cable with a nylon coating. In one embodiment, cable 24 comprises plastic. Mallet holder 22, in one embodiment, may also comprise a force-activated release mechanism 50. Force-activated release mechanism 50 may be configured to allow mallet 20 to be snugly held, but in response to an applied force on cable 52 or mallet 20, release mallet 20 from mallet holder 22. Force-activated release mechanism 50 may provide easy access to mallet 20 and may, in one embodiment, serve as a safety mechanism preventing user entanglement or injury by cable 24. Force-activated release mechanism 50, in one embodiment, may comprise one or more pliable tabs. Force-activated release mechanism 50, in one embodiment, may comprise magnets. Force-activated release mechanism 50, in one embodiment, may comprise springs. Force-activated release mechanism 50 may also comprise any other suitable mechanism.

Base 18 is configured to support a plurality of tone producers 14. The location and orientation of base 18 may provide access to metallophone 12 to users of all ages and abilities. In one embodiment base 18 is oriented parallel to the ground. In one embodiment, base 18 is angled with respect to the ground. In one embodiment, base 18 is metal. In one embodiment, base 18 is plastic.

Base 18 is, in one embodiment, also coupled to mount 24. Mount 24 may be configured to maintain the location and orientation of base 18. Metallophone 12 may comprise one or more mount 24. In one embodiment, mount 24 comprise one or more legs, for example 1, 2 or 4. In one embodiment, mount 24 is metal.

Mount 24 is coupled to mounting structure 26. Mounting structure 26, in one embodiment, comprises a permanent installation, for example a concrete footing or underground. Mounting structure 26, in one embodiment, is a playground structure. Mounting structure 26, in one embodiment, comprises a structure, for example, a building. In one embodiment, mount 24 is coupled to mounting structure 26 utilizing a footing. In one embodiment, mount 24 is coupled to mounting structure 26 utilizing one or more fasteners.

Figure 1B:
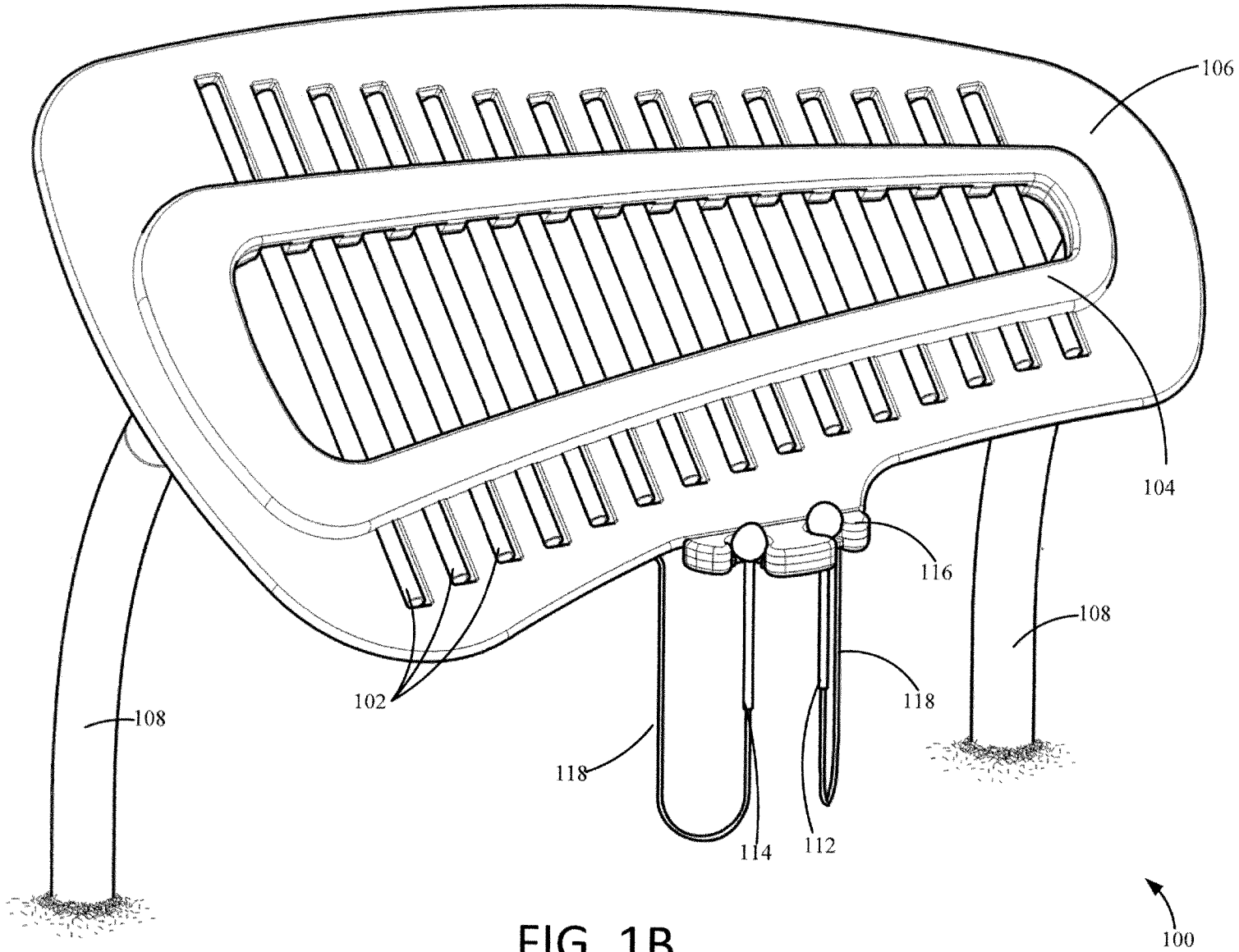
FIG. 1B and FIG. 1C illustrate perspective views of metallophone in accordance with embodiments of the present invention.

FIG. 1B illustrates a perspective view of a metallophone in accordance with one embodiment of the present invention. Metallophone 100 comprises a set of tone mechanisms 102, a shield 104, a base 106, a mount 108, a mallet 112, and a mallet 114. Tone mechanism 102 is a component configured to produce a desired musical sound when activated. In the embodiment of FIG. 1B, tone mechanism 102 is a metal tube, tuned to produce a specified note when struck. In other embodiments, tone mechanism 102 may comprise a tone bar or any other suitable mechanism comprising any material producing a desired tone when activated. However, in other embodiments, tone mechanism 102 comprises any material that is substantially weather proof and configured to maintain sound quality after an outdoor exposure period. For example, tone mechanism 102 can comprise any of: wood, composite, fiberglass, metal, or any other suitable material. In one embodiment, tone mechanisms 102 all comprise the same shape, e.g. all bars or all tubes. In one embodiment, tone mechanisms 102 all comprise the same material, e.g. all metal or fiberglass. In one embodiment, at least some tone mechanisms 102 comprise different shapes. In one embodiment, at least some tone mechanisms 102 comprise different materials. In one embodiment, tone mechanisms 102 vary in lengths but are all greater than 15". In one embodiment, tone mechanisms 102 vary in lengths, but all are less than 36". In one embodiment, tone mechanisms 102 are sized such that, when activated, pitches across one octave range are generated. In another embodiment, tone mechanisms 102 generate pitches from more than one octave. Exact lengths of different tone mechanisms 102, within a set of tone mechanisms for a metallophone 100, may be selected based on known mathematical equations, such that each produces a desired sound frequency. In one embodiment, the sound frequency produced at installation is the same as a sound frequency produced after a period of outdoor exposure, such that retuning is not required.

In one embodiment, sound is produced by striking tone mechanism 102 with either of mallets 112 and 114. In one embodiment, mallet 112 comprises the same material as mallet 114. In another embodiment, mallets 112 and 114 comprise different materials, such that they create different sounds when striking the same tone mechanism 102. In one embodiment, mallets 112 and 114 are free hanging. In one embodiment, mallets 112 and 114 are detached from base 106. Mallet 112 and mallet 114, in one embodiment, for example as shown, are configured for temporary storage in mallet holder 116. In one embodiment, mallet holder 116 is separate from base 106. In another embodiment, mallet holder 116 is part of base 106. Mallet holder 116, in one embodiment, includes a quick release mechanism (not shown) that allows mallet 112 and mallet 114 to be snugly held in mallet holder 116, but, in response to an applied force on cable 118, for example either of mallets 112 and 114 will be disconnected from mallet holder 116. The quick release mechanism may act as a safety mechanism that prevents a child from being entangled in or hurt by cable 118. While discouraging theft of mallets 112 and 114, cable 118 may be long enough to allow access to all tone mechanisms 102 by at least one, or both of, mallets 112, 114. Cables 118, in one embodiment, are only long enough to encourage use of mallets 112 and 114 with select sets of notes, e.g. mallet 112 for a low octave and mallet 114 for a high octave.

In one embodiment, tone mechanisms 102 are coupled to base 106, such that, when struck, each tone mechanism 102 is configured to vibrate substantially freely, producing a high quality sound. In one embodiment, base 106 is at least 65" wide. In one embodiment, base 106 is less than 70" wide. Base 106 in one embodiment, comprises metal. In another embodiment, base 106 comprise a durable plastic. Base 106 is held above the ground by one or more mounts 108. In one embodiment, metallophone 100 comprises two mounts 108, but in other embodiments there may be one mount 108, or more than two, for example, a set of four mounts 108. Mounts 108 may be configured, in one embodiment, to keep base 106 at a height easily accessible for users of all ages. In one embodiment, mounts 108 may be at such an angle and height as to allow a person in a wheelchair easy access to mallets 112 and 114 and tone mechanisms 102. In one embodiment, mounts 108 maintain a minimum knee clearance of 27," as recommended by the ADA (Americans with Disabilities Act), for sufficient accessibility. In one embodiment, metallophone 100 is directly mounted to another play structure.

Metallophone 100 may also comprise a shield 104. Shield 104, in one embodiment, is configured to prevent mallets 112 and 114 from striking one or more fastener mechanisms (not shown), which could cause damage to the fastener mechanisms or mallets 112 and 114. In one embodiment, shield 104 and base 106 are separate components. In another embodiment, shield 104 is part of base 106. In one embodiment, shield 104 comprises metal. In another embodiment, shield 104 comprises a durable plastic. The durable plastic, in one embodiment, comprises a Ultra violet light (UV) resistant plastic.

Figure 1C:
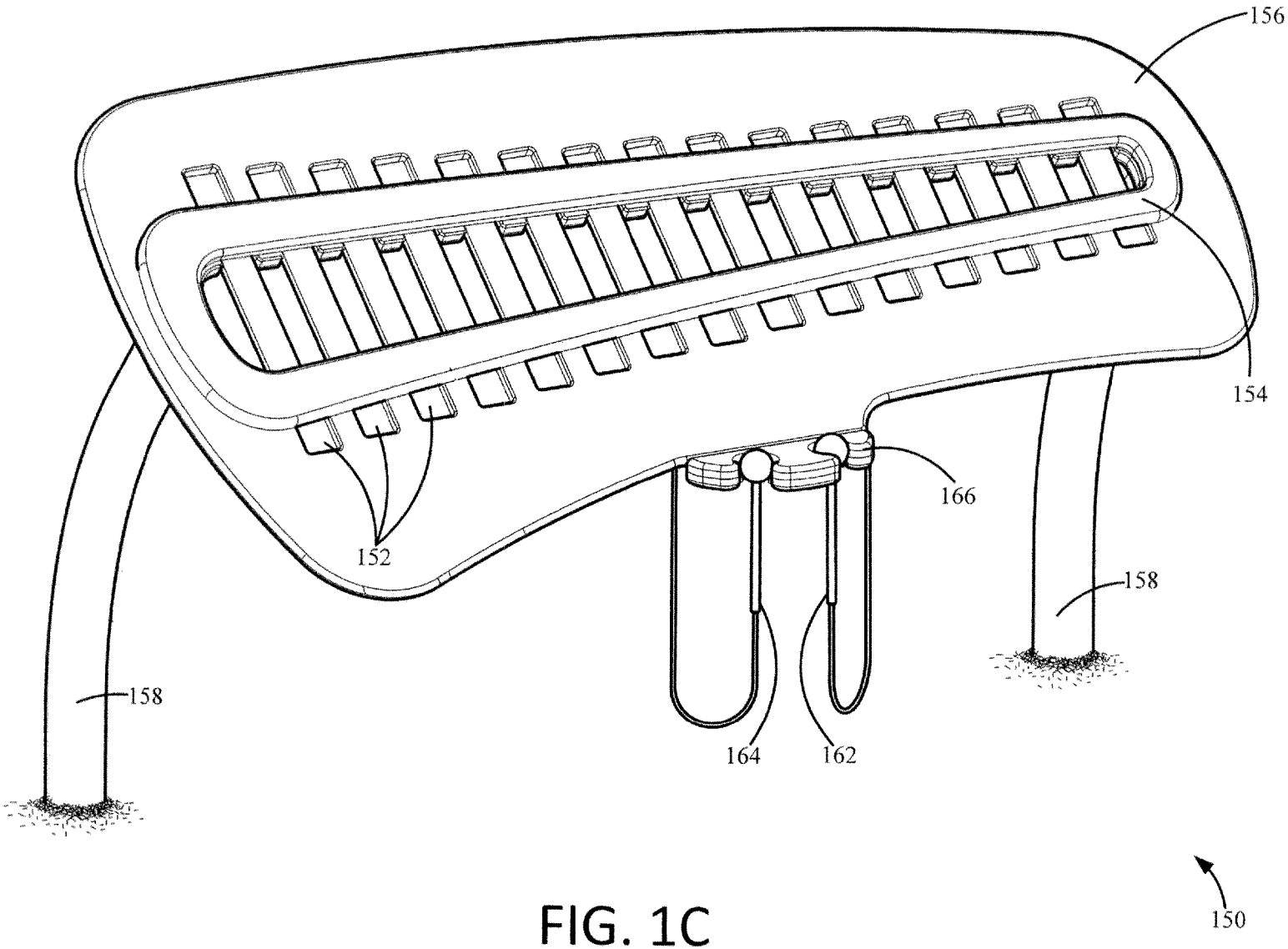

FIG. 1C illustrates a perspective view of a metallophone in another embodiment of the present invention. Metallophone 150, in one embodiment, includes a base 156, a shield 154, tone mechanisms 152, a stand 158, mallet 164, mallet 162 and mallet holder 166. Tone mechanisms 152 comprises tone bars, in one embodiment. In one embodiment, tone mechanisms 152 are substantially solid. In another embodiment, tone mechanisms 152 are at least partially hollow. In the embodiment shown in FIG. 1C, a sound is produced by striking tone mechanism 152 with a mallet, such as either of mallets 162 or 164. Tone mechanisms 152 may comprise different materials. In one embodiment, tone mechanisms 152 comprise metal. In another embodiment, tone mechanisms 152 comprise durable wood. In another embodiment, tone mechanisms 152 comprise fiberglass, composite, or another suitable, substantially weatherproof material. One skilled in the art would understand that the name of specific members of the idiophone family of instruments depends on the shape/composition of mechanism 152. However, for the sake of simplicity, but not by limitation, the term metallophone is used herein.

In one embodiment, tone mechanisms 152 vary in lengths, with all being less than 25". In one embodiment, the tone mechanisms 152 vary in lengths, with all being greater than 9". In one embodiment, tone mechanisms 152 are sized such that they generate pitches across one octave when struck. In another embodiment, tone mechanisms 152 generate pitches across more than one octave. In one embodiment, tone mechanisms 152 are arranged from longest to shortest length. In another embodiment, tone mechanisms 152 are not arranged by length, or only partially by length. In one embodiment, metallophone 150 comprises resonance tubes (not shown) located underneath tone mechanisms 152 to increase the quality of sound produced. In one embodiment, there are more than 10 tone mechanisms 152. In one embodiment there are fewer than 20 tone mechanisms 152. In one embodiment there are 15 tone mechanisms 152.

To further distinguish the sound produced, in some embodiments, mallet 162 and mallet 164 can comprise different material compositions, selected for compatibility with a subset of tone mechanisms 152. In one embodiment, mallets 162 and/or 164 comprise rubber. In another embodiment, mallets 162 and/or 164 comprise plastic. In one embodiment, mallets 162 and/or 164 comprise polyurethane. In another embodiment, mallets 164 and/or 162 comprise a durable foam.

Figure 2A:
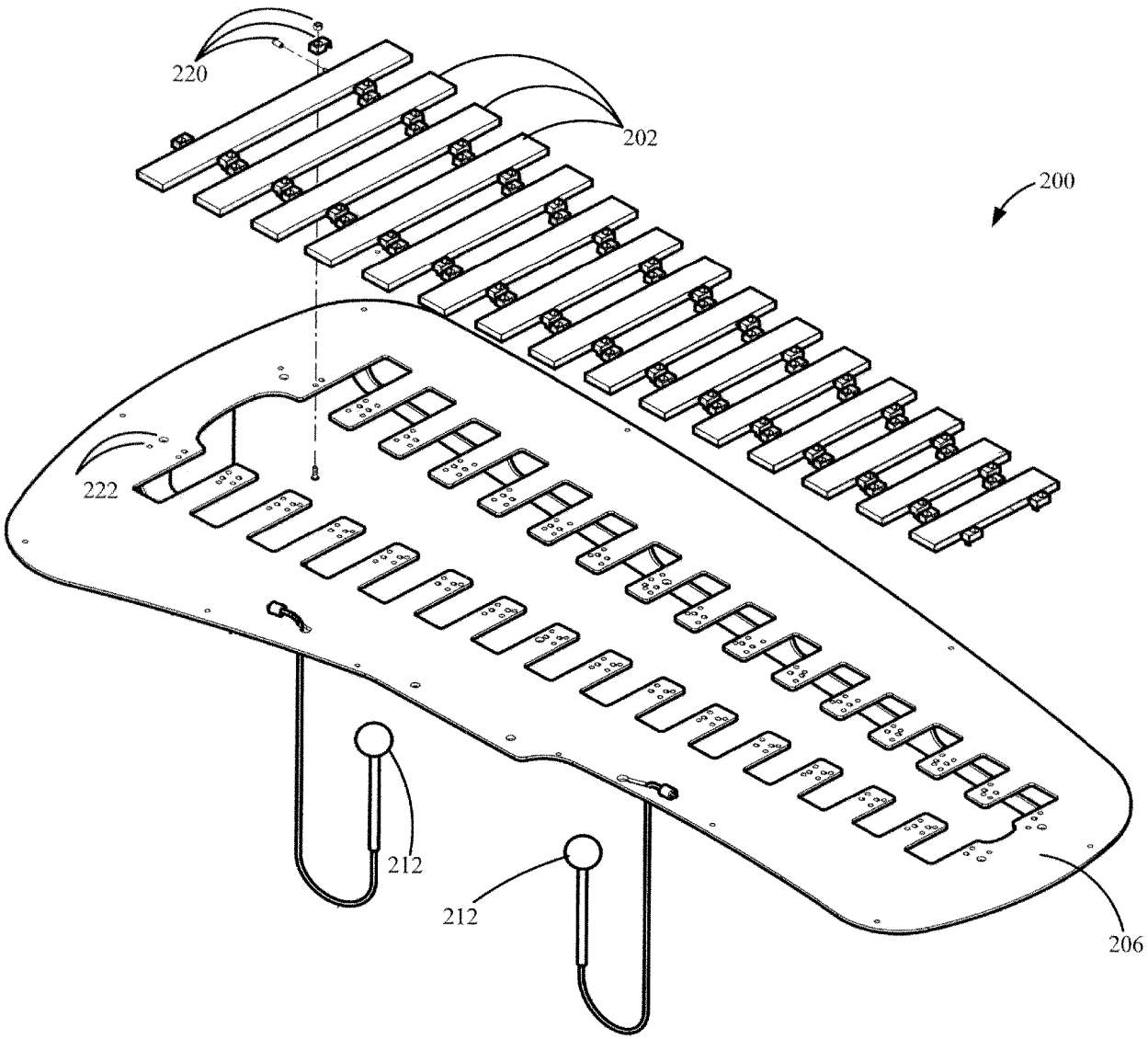
FIGS. 2A and 2B illustrate exploded views of a partially assembled outdoor metallophone in accordance with one embodiment of the present invention.

FIG. 2A illustrates an exploded view of a partially assembled outdoor metallophone in accordance with one embodiment of the present invention. Metallophone assembly 200, in one embodiment, includes a plurality of fastening mechanisms 220 that couple a plurality of tone mechanisms 202 to base 206 at a plurality of receiving points 222. Fastening mechanisms 220 are configured to support tone mechanisms 202 such that sound is freely produced, but tone mechanisms 202 remain in place such that they cannot easily be removed or damaged. Tone mechanisms 202, in one embodiment, are coupled to base 206 by the use of fastening mechanisms 220. Fastening mechanisms 220, in one embodiment, comprises a nut and bolt. Fastening mechanisms 220, in one embodiment, comprises a pin and pin cap. In another embodiment, fastening mechanisms 220 may comprise rivets, machine screws or any other suitable mechanism configured to hold tone mechanism 202 to base 206, such that each tone mechanism 202 can vibrate freely without fastening mechanism 220 stifling a substantial amount of sound.

Mallets 212 are connected to base 206 through a cable 216, in one embodiment. In one embodiment, cable 216 comprises a coated stainless steel cable. In another embodiment, cable 216 comprises a plastic cord. It is well understood that cable 216 is not limited to the embodiments here specified and those in the art would recognize that any mechanism that can securely couple mallets 212 to the structure would properly function as cable 216.

Figure 2B:
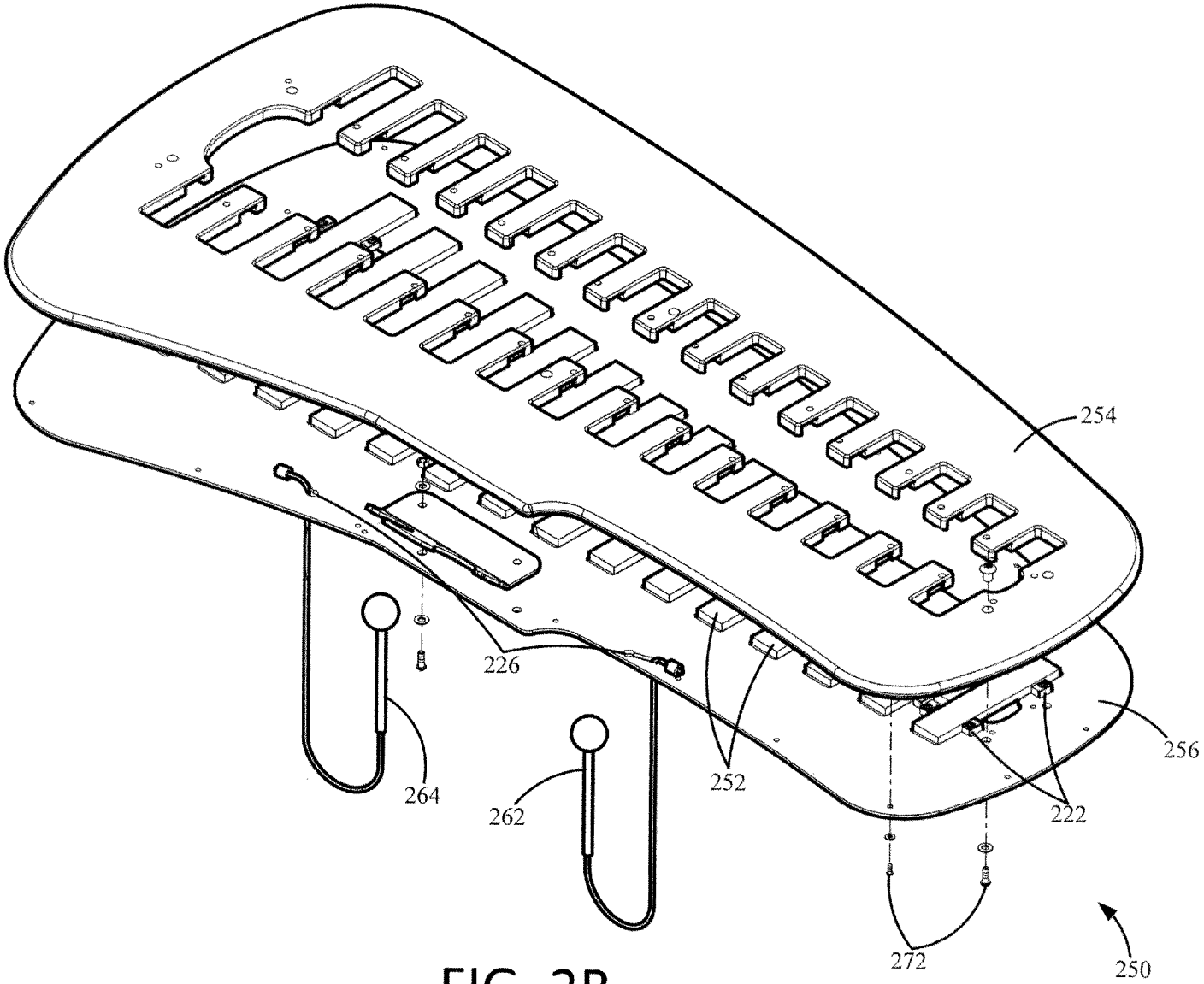

FIG. 2B illustrates an exploded view of an outdoor metallophone in accordance with one embodiment of the present invention. Metallophone 250, in one embodiment, comprises a shield 254, a base 256, tone mechanisms 252, mallet 262 and mallet 264. Shield 254 is coupled to base 256 through the use of fasteners 272. In one embodiment, shield 254 is configured to provide some protection for base 256 and tone fasteners 222 from being struck by mallets 262 and 264. Shield 254, in one embodiment, may also provide some protection from weather related damage. Shield 254, in one embodiment, may also protect an attachment point 226 where mallets 262 and 264 connect to base 306. Shield 254, in one embodiment, may be more aesthetically pleasing than base 256 alone. In one embodiment, shield 254 helps to secure mallets 262 and 264 to base 256.

FIG. 3 illustrates some example specifications for a tone bar set in accordance with one embodiment of the present invention. Tableset 300 comprises specifications for a metallophone configuration 302, a tubular bell configuration 304 and a tubular bell configuration 306, all of which comprise a plurality of octaves 310. In one embodiment, the tone configurations include more than one octave. In one embodiment, the tone configurations represent notes from one octave. In one embodiment, metallophone configuration 302 represents bars ½" thick and 2" wide. In one embodiment, the bars are made out of aluminum. In one embodiment, metallophone configuration 304 represents tubes 1.250" diameter with 0.125" thick walls. In one embodiment, metallophone configuration 306 represents tubes 3" diameter with 0.125" thick walls. In the embodiment of FIG. 3 the configurations illustrate a set of two octaves 310. In other embodiments, configurations may comprise fewer or greater numbers of octaves 310. In the embodiment of FIG. 3, the octaves 310 range from C-C. In other embodiments, the octaves 310 may comprise a different note range. In one embodiment, an octave 310 may be a partial octave containing fewer than 8 notes.

Figure 4A:
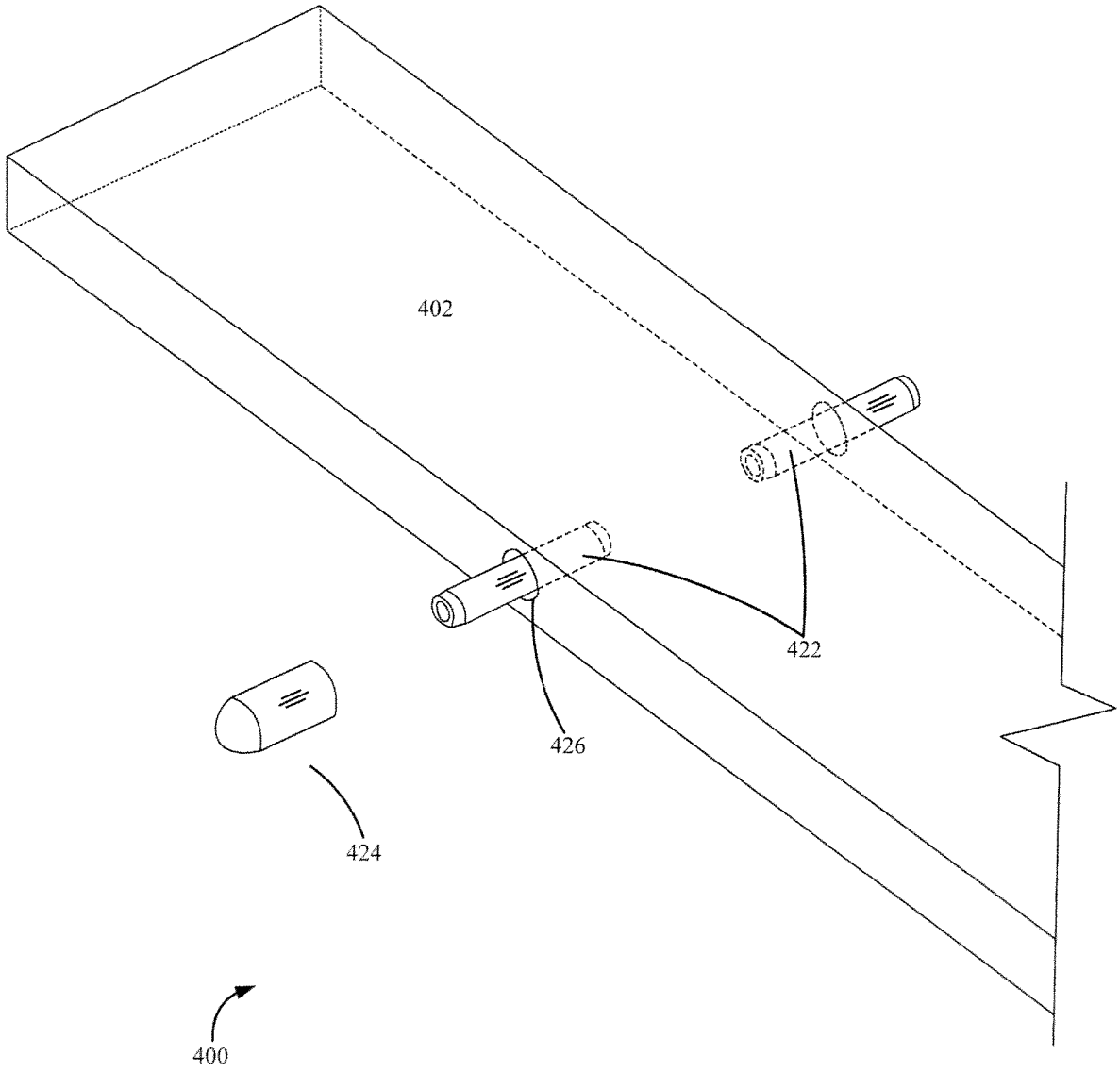
FIG. 4A illustrates an isolated exploded view of a tone bar attachment assembly in accordance with one embodiment of the present invention.

FIG. 4A illustrates an isolated exploded view of a tone bar attachment assembly in accordance with one embodiment of the present invention. Tone bar attachment assembly 400, in one embodiment, comprises a cap 424, attachment mechanisms 422 and tone mechanism 402. Components of tone bar attachment assembly 400, in one embodiment, comprise materials selected for weatherproof properties. In one embodiment, tone bar attachment assembly 400 comprises components that are substantially rust-proof, and experience little or no expansion or contraction with changes in ambient temperature, for example with changing seasonal climate conditions.

In one embodiment, attachment mechanisms 422 are configured to be at least partially disposed within an aperture 426 of tone mechanism 402. Aperture 426 may be machined into tone mechanism 402. Attachment mechanisms 422 may comprise a pin as shown in the embodiment of FIG. 4. In one embodiment, aperture 426 may extend partially all the way through bar 402, such that attachment mechanism 422 comprises a single pin extending through substantially the full length of tone mechanism 402. In another embodiment, attachment mechanisms 422 may be manufactured as part of tone mechanism 402. Cap 424 is placed at least partially over an end of attachment mechanisms 422. Cap 424 may provide some protection of the ends of attachment mechanisms 422. Cap 424 may also reduce unwanted vibrations that affect the quality of sound produced by tone mechanism 402, while still allowing sufficient vibration to achieve a desired sound quality. Cap 424 may comprise an elastic material configured to maintain a closer fit on attachment mechanism 422. Cap 424 may also comprise a compressible material, such that an expansion force of the compressible material produces a tight fit of attachment mechanism 422 within a mounting mechanism (not shown). In one embodiment, however, attachment mechanism 422 engages directly with aperture 426, without cap 426.

Figure 4B:
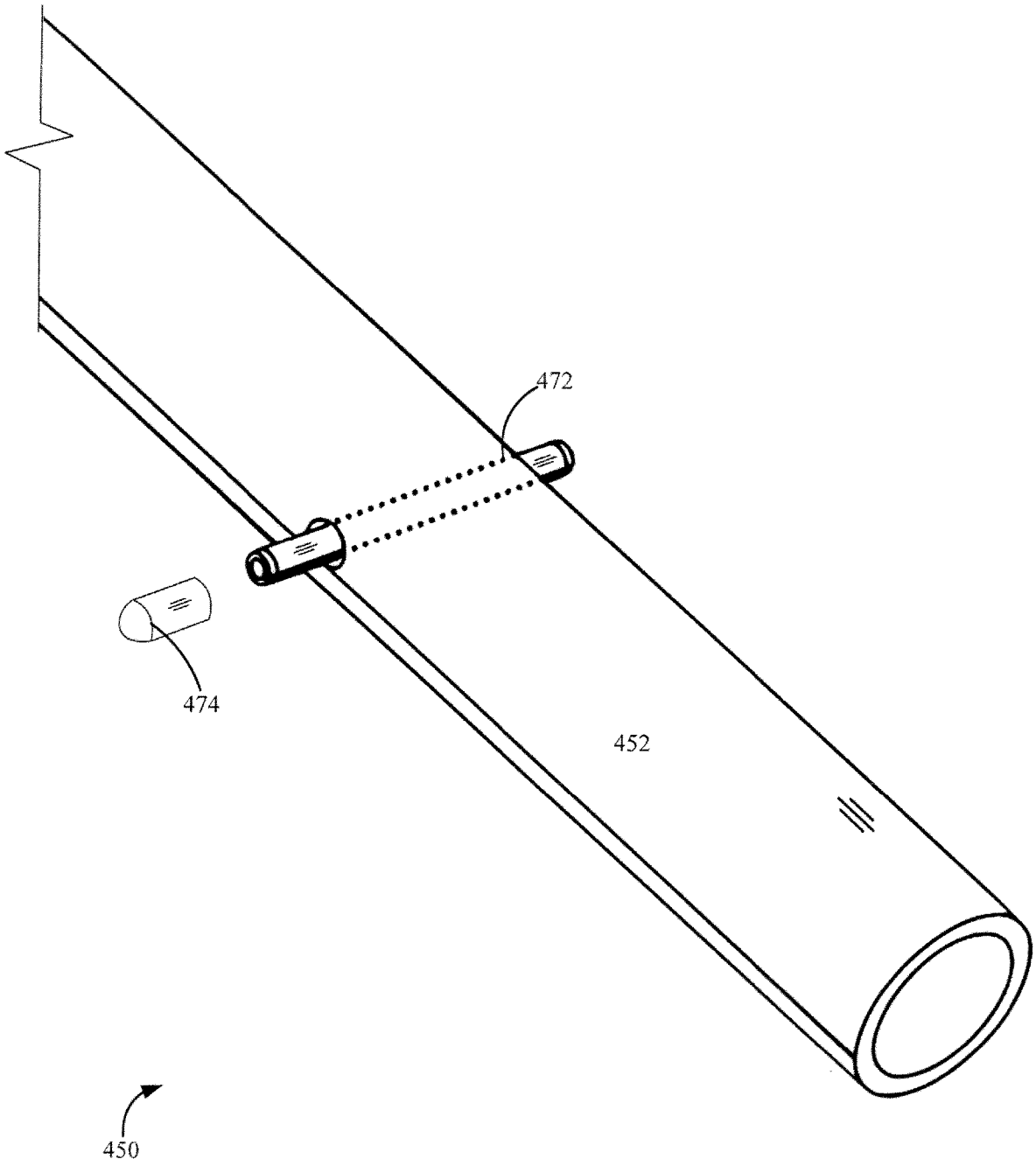
FIG. 4B illustrates an isolated exploded view of a tone tube attachment assembly in accordance with one embodiment of the present invention.

FIG. 4B illustrates an isolated exploded view of a tone tube attachment assembly in accordance with one embodiment of the present invention. Tone tube assembly 450 includes a cap 474, attachment mechanism 472 and tone mechanism 452. In one embodiment, attachment mechanism 472 is at least partially disposed within tone mechanism 452. Attachment mechanism 472 may comprise a single pin, in one embodiment. In another embodiment, attachment mechanism 472 may comprise multiple pins coupled to the wall of tone mechanism 452. In another, embodiment attachment mechanisms 472 may be a part of tone mechanism 452. Cap 424, in one embodiment, is configured to be inserted over an end of attachment mechanism 472. Cap 474 may provide protection to an end of attachment mechanism 472. Cap 474 may also help to reduce vibrations that alter the quality of sound produced by tone mechanism 452. Cap 474 may also comprise a compressible material, such that an expansion force of the compressible material produces a tight fit of attachment mechanism 472 within a mounting mechanism (not shown). In one embodiment, however, attachment mechanism 472 engages directly with aperture 476, with no cap 476.

Figure 5:
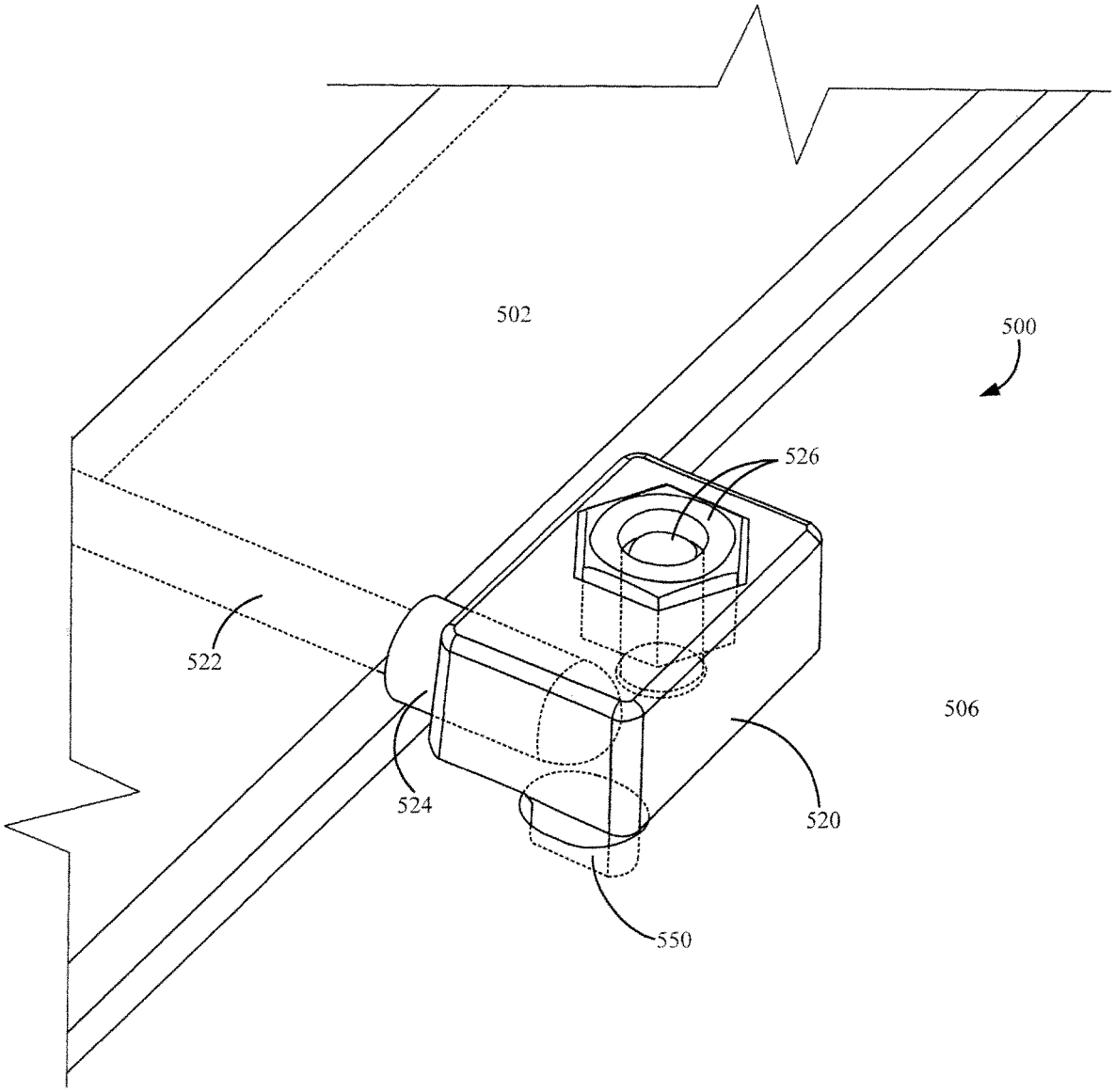
FIG. 5 illustrates a tone mechanism assembly in accordance with one embodiment of the present invention.

FIG. 5 illustrates a tone mechanism assembly in accordance with one embodiment of the present invention. Tone mechanism attachment assembly 500, in one embodiment, is configured to allow for a theft-resistant coupling between a tone mechanism and a metallophone base, while allowing for tone mechanism to produce a high quality sound when struck. In one embodiment, tone mechanism attachment assembly 500 also comprises materials that are substantially weatherproof. For example, tone mechanism attachment assembly 500 is substantially rust-proof, and does not experience material deformation in response to seasonal temperature changes Tone mechanism attachment assembly 500, in one embodiment, comprises a base 506, tone mechanism 502, an attachment mechanism 522, a cap 524, a mounting mechanism 520 and fasteners 526. Attachment mechanism 522 is configured, in one embodiment, to run through tone mechanism 502. Cap 524 in one embodiment, is disposed at least partially within an inlet of mounting mechanism 520.

As fasteners 526 are tightened, in one embodiment, mounting mechanism 520 is brought closer to base 506 and secures cap 524 to base 506. In one embodiment, cap 524 comprises a compressible material that hinders vibration to produce a better quality sound from tone mechanism 502. Cap 524 may also provide a more secure connection of tone mechanism 502 to base 506. Cap 524 may comprise rubber, in one embodiment. Cap 524 may comprise plastic, in one embodiment. Cap 524 may comprise metal, in one embodiment. Mounting mechanism 520, in one embodiment, may comprise plastic, rubber or metal. Fasteners 526, in one embodiment, comprise a nut and a bolt. In another embodiment, assembly 500 comprises a single fastener 526 that directly connects to mounting mechanism 520 through a threaded connection. In the embodiment of FIG. 5, fastener 526 is configured to engage mounting mechanism 520 in one position. However, there may be additional fasteners 526, engaging mounting mechanism 520 in additional positions, in another embodiment. Mounting mechanism 520 is shown in FIG. 5 with an extrusion 550 engaging an aperture of base 506, however fasteners 526 on their own may be able to securely couple mounting mechanism 520 to base 506.

Figure 6:
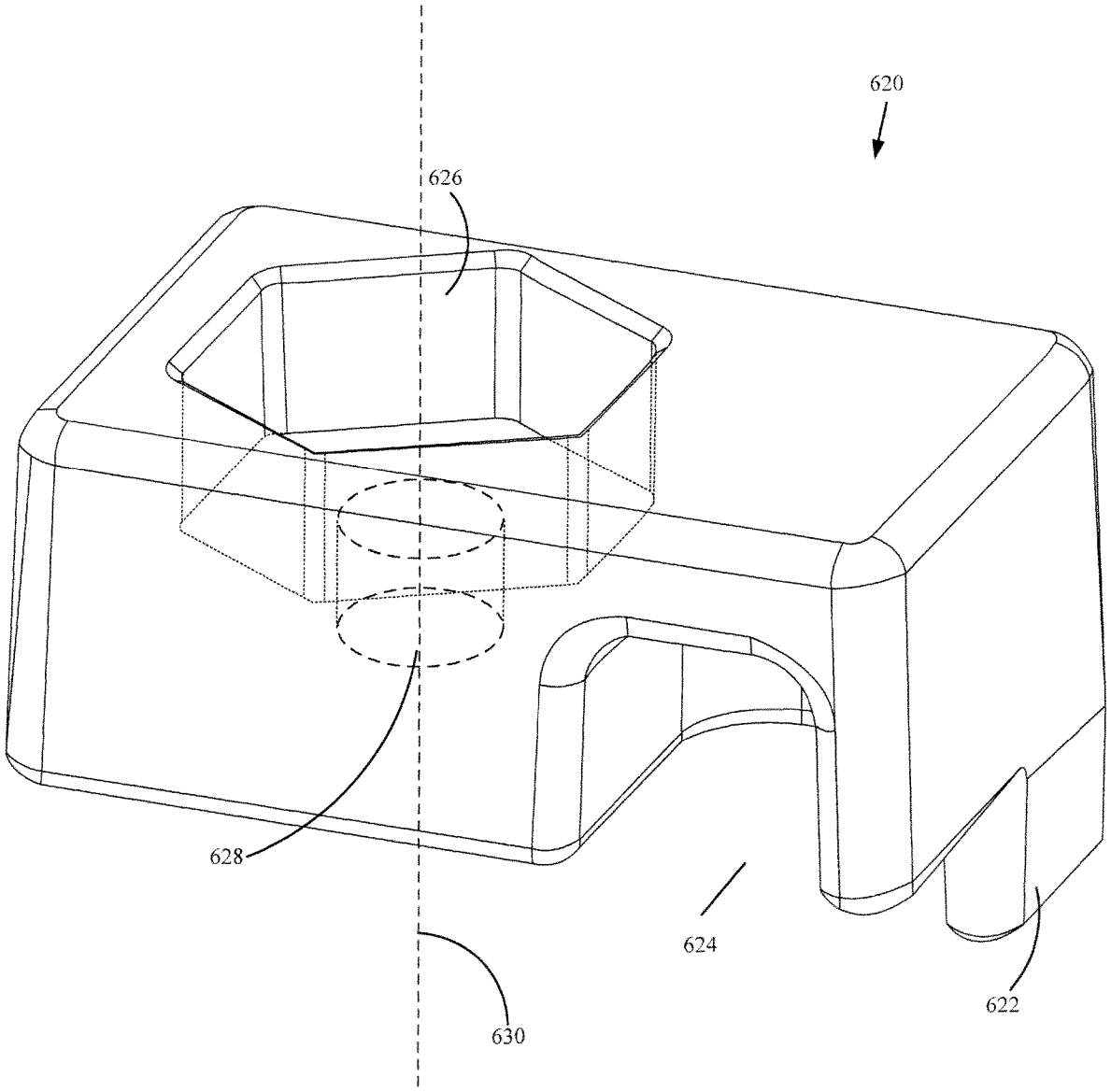
FIG. 6 illustrates an enlarged view of a mounting mechanism in accordance with one embodiment of the present invention.

FIG. 6 illustrates an enlarged view of a mounting mechanism in accordance with one embodiment of the present invention. Mounting mechanism 620, in the embodiment shown in FIG. 6, comprises a mounting protrusion 622, a tone mechanism fastener inlet 624, a mounting fastener inlet 626 and a mounting fastener outlet 628. In one embodiment, mounting fastener outlet 628 has a larger diameter than a received bolt such that the bolt passes through it. In one embodiment, mounting fastener inlet 626 is shaped and configured to receive a nut within it, and is shaped to substantially prevent rotation of the nut. In another embodiment, mounting fastener outlet 628 has a threaded interior surface. In one embodiment, mounting protrusion 622 is of such a shape to fit in an aperture as to prevent the rotation of mounting mechanism 620 around the center axis of mounting fastener outlet 628. In some embodiments, mounting protrusion 622 may be replaced by another suitable fastener configuration. In one embodiment, the different fastener is another mounting fastener outlet 628 and mounting fastener inlet 626. Tone mechanism fastener inlet 624, in one embodiment, includes a concave surface providing an inlet for a tone mechanism fastener to fit within. Tightening nut and bolt received in mounting fastener inlet 626 and mounting fastener outlet 628, respectively, would also tighten the space within tone mechanism fastener inlet 624 thereby creating a secure mount of a tone bar.

Figure 7A:
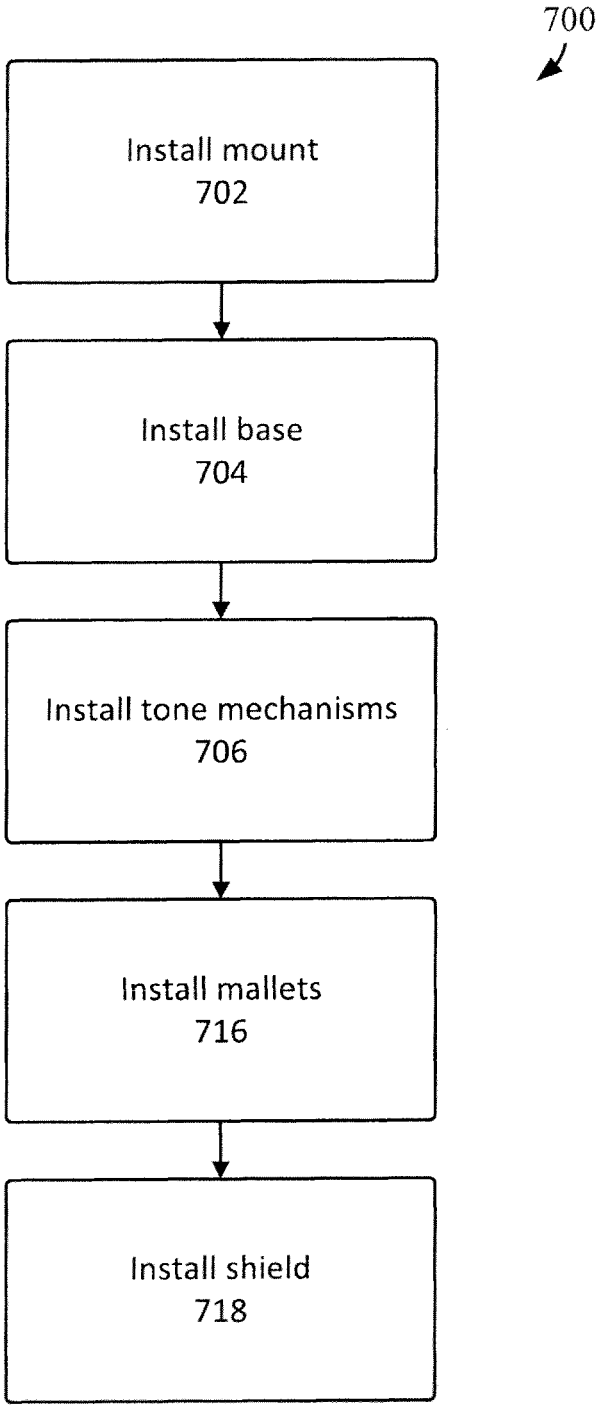
FIG. 7A illustrates a flow diagram of a method of installing a metallophone in accordance with an embodiment of the present invention.

FIG. 7A illustrates a flow diagram of a method of installing a metallophone in accordance with an embodiment of the present invention. In one embodiment, method 700 allows for a metallophone to be installed in an outdoor environment such that it is substantially theft-resistant, vandal-resistant, weather-resistant, and configured to maintain an installed sound quality over its installed lifetime. In one embodiment, a metallophone is configured to maintain its sound quality, and stay in tune, for over a year. In one embodiment, the metallophone maintains its sound quality, without needing additional tuning or maintenance, for over 2 years, or for over 5 years, or for over 10 years, or for over 15 years.

At block 702 the mount is installed. In one embodiment, the mount is coupled to the ground through use of a concrete footing. In another embodiment, the mount is coupled to a mounting structure, or the ground, using a surface mount.

At block 704 the base is installed. In one embodiment, the base is coupled to the mount utilizing fasteners. In one embodiment, the fasteners are rivets. In one embodiment, the fasteners are bolts. In one embodiment, the fastener is a weld. In another embodiment, the mount and base may be manufactured as one part and are installed simultaneously.

At block 706 the tone mechanisms are installed. The tone mechanisms, in one embodiment, are installed by coupling the tone mechanisms to the base through use of fasteners. In one embodiment, the tone mechanisms are installed through a method similar to the method of FIG. 7B. In one embodiment, the tone mechanisms are installed through use of welds. In one embodiment, installing tone mechanisms comprises a theft-resistant installation, such that tone mechanisms can vibrate freely but are not easily removable once installed. In one embodiment, installing tone mechanisms comprises the tone mechanisms installed such that each provides a desired sound frequency at installation, and such that each is configured to provide the same sound frequency after a period of outdoor exposure.

At block 716 one or more mallets are installed. In one embodiment, the mallets are not coupled to the structure, and installing the mallets comprises providing the mallets. In one embodiment, the mallets are coupled to a based via a cable. In one embodiment, the cable is inserted through an aperture and slid into a locking channel (see FIG. 2A). In one embodiment, the cable is clamped onto a mounting structure. At block 718 a shield is installed. In one embodiment, the shield is coupled to the base via fasteners. In one embodiment, the fasteners comprise a nut and bolt. In one embodiment, the shield is coupled to the base by a snap fitting.

Figure 7B:
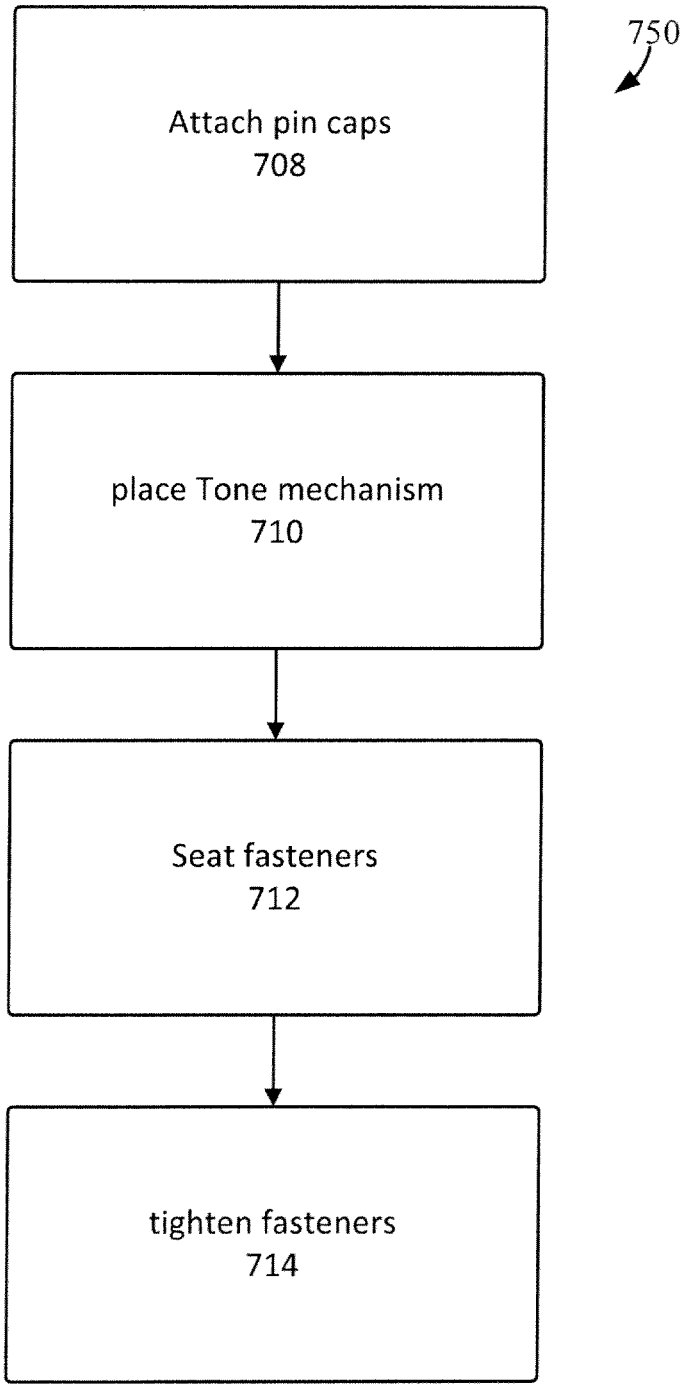
FIG. 7B illustrates a flow diagram of a method of installing a tone mechanism in accordance with an embodiment of the present invention.

FIG. 7B illustrates a flow diagram of a method of installing a tone mechanism in accordance with an embodiment of the present invention. Method 750 may be used, for example, to install tone mechanisms in block 706 of FIG. 7A.

At block 708, in one embodiment, caps are coupled over the end of pins extending from the side of a tone mechanism. In another embodiment, the caps may be manufactured onto the pins of a tone mechanism. In another embodiment, there are no caps.

At block 710 the tone mechanisms are placed at their installation location. In one embodiment, the tone mechanisms' pins may rest on the surface they will couple to.

At block 712 fasteners are seated. In one embodiment, the fasteners are the fasteners described and shown with respect to FIG. 5. In one embodiment, the fastener is a weld, such that the tone mechanism is welded to the base at a connection point.

At block 714 the fasteners are tightened. In one embodiment, the fasteners are the fasteners described and shown with respect to FIG. 5, and tightening the fasteners comprising tightening a nut and bolt. Tightening the nut and bolt will, in one embodiment, tighten the pin to the base and prevent the tone mechanisms from being removed.

Figure 8:
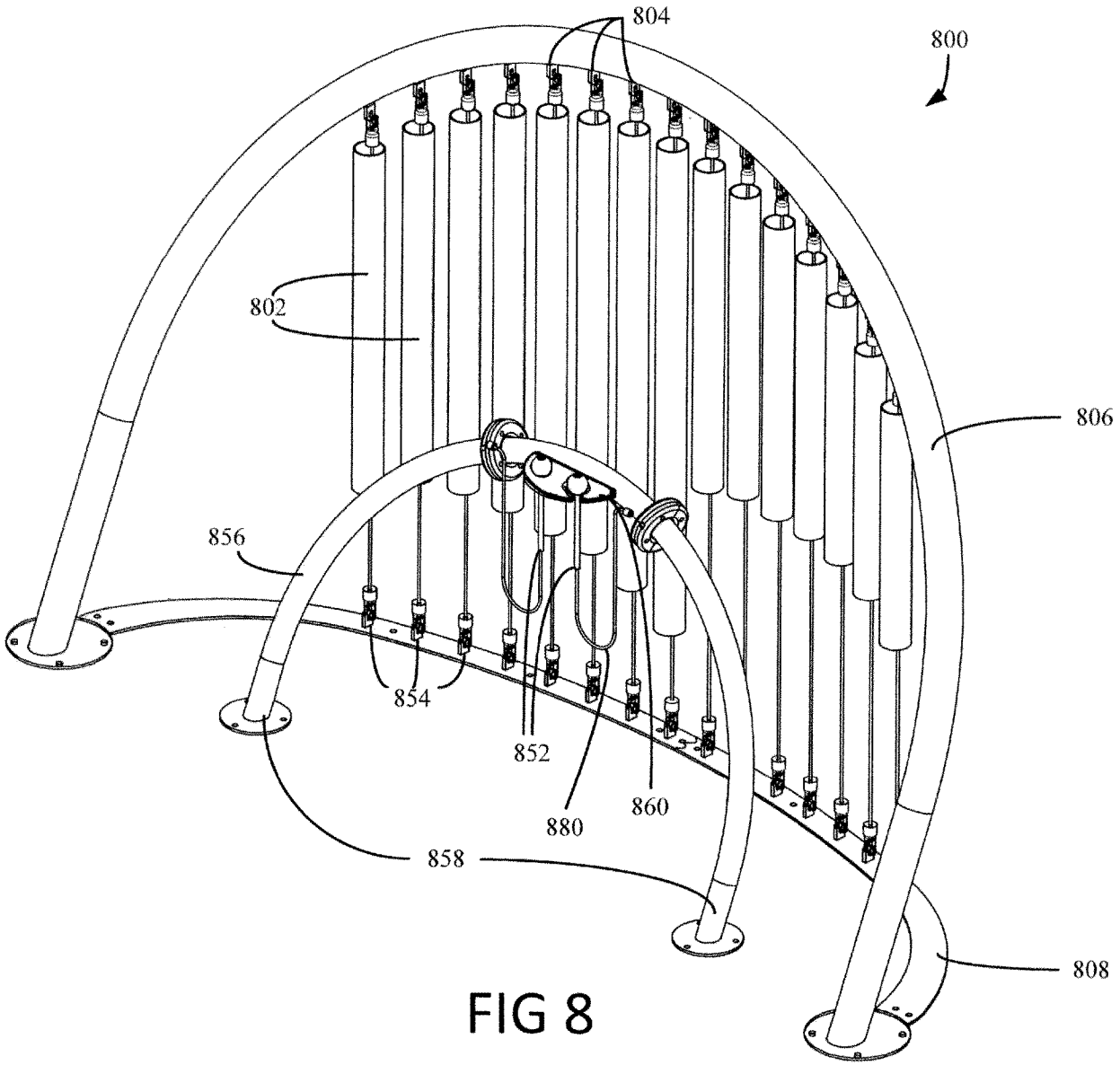
FIG. 8 illustrates a perspective view of a set of outdoor musical chimes in accordance with one embodiment of the present invention.

FIG. 8 illustrates a perspective view of a set of outdoor musical chimes in accordance with one embodiment of the present invention. Outdoor chimes 800 are shown in FIG. 8 with a variety of components, at least some of which may be optional in some embodiments. The sound of outdoor chimes 800 is produced, in one embodiment, by actuation of tone mechanisms 802, Tone mechanisms 802, in one embodiment, are mounted on an outer frame 806. In one embodiment, tone mechanisms 802 are mounted to outer frame 806 through the use of upper mount mechanism 804 and lower mount mechanisms 854.

In one embodiment, outdoor chimes 800 are configured to be theft-resistant such that, once installed, individual components are not easily removable. In one embodiment, outdoor chimes 800 are configured to be vandal-resistant. In one embodiment, chimes 800 comprise substantially weather-proof materials such that they are not damaged by prolonged outdoor exposure. In one embodiment, outdoor chimes 800 are configured to produce a set of sound frequencies at installation, and substantially the same set of sound frequencies after a period of outdoor exposure, without needing to be re-tuned. For example, in one embodiment, outdoor chimes 800 are configured to maintain sound quality for up to one year, or up to two years, or up to three years, or up to four years, or up to five years, or even longer after the initial installation.

Tone mechanisms 802, in one embodiment, produce sound when struck, preferably by mallets 852. Mallets 852, in one embodiment, can comprise a variety of different materials. In one embodiment, mallets 852 both comprise the same material, in another embodiment, mallets 852 comprise two different materials. In one embodiment, mallets 852 are stored in mallet holder 860. In one embodiment, mallet holder 860 comprises a force release system where mallets 852 are supported, but if enough force is applied mallets 852 will freely release from mallet holder 860. This may provide a safety feature that prevents children from being caught in the mounting cables 880 of mallet 852. In one embodiment, mallet holder 860 is coupled to inner frame 856. Alternatively, mallets 852 could be free standing and not attached to any mallet holder 860. In another embodiment, mallets could be attached to outer frame 806.

Mallets 852, in one embodiment, are attached to inner frame 856 by a durable cable. In one embodiment, inner frame 856 may be of such a height as to allow wheelchair accessibility and/or easy access by children. In one embodiment, the inner frame 856 is located at a height that maintains a minimum knee clearance of 27" as recommended by the ADA for sufficient accessibility. Inner frame 856 is attached to the ground through base 858, in one embodiment. Outer frame 806 is attached to the ground through base 808, in one embodiment.

Figure 9:
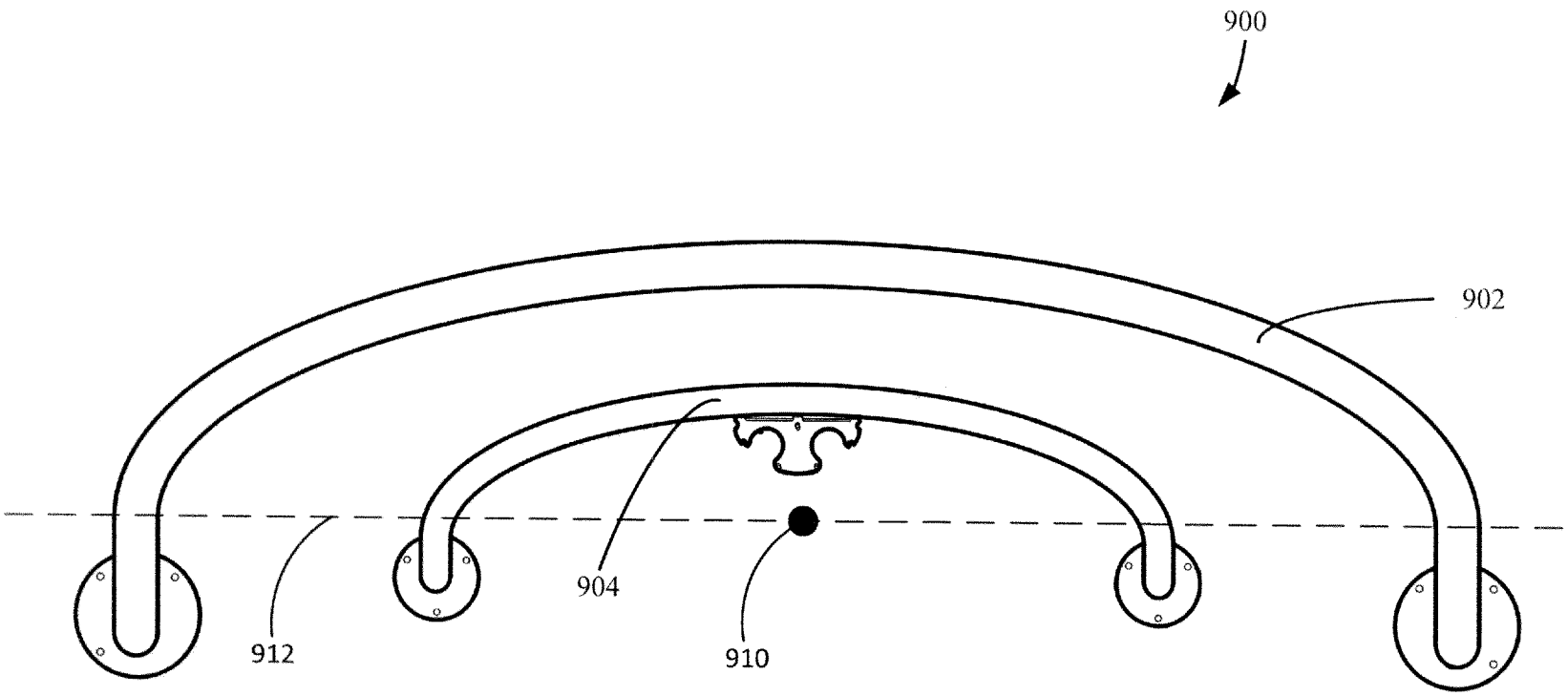
FIG. 9 illustrates a top down view of a chime set in accordance with one embodiment of the present invention.

FIG. 9 illustrates a top down view of a chime set in accordance with one embodiment of the present invention. Chimes 900 comprise an outer frame 902 and an inner frame 904, in one embodiment. Reference point 910 is provided to show where a user of chimes 900 may be located. The curvature of inner frame 904 and outer frame 902 may be configured such that it allows easy access by a person located at reference point 910 to all chimes and mallets. This curvature of outer frame 902 and inner frame 904 especially allows for greater accessibility to those who may be in a wheelchair, who have more restricted lateral movement, plane 912.

Figure 10:
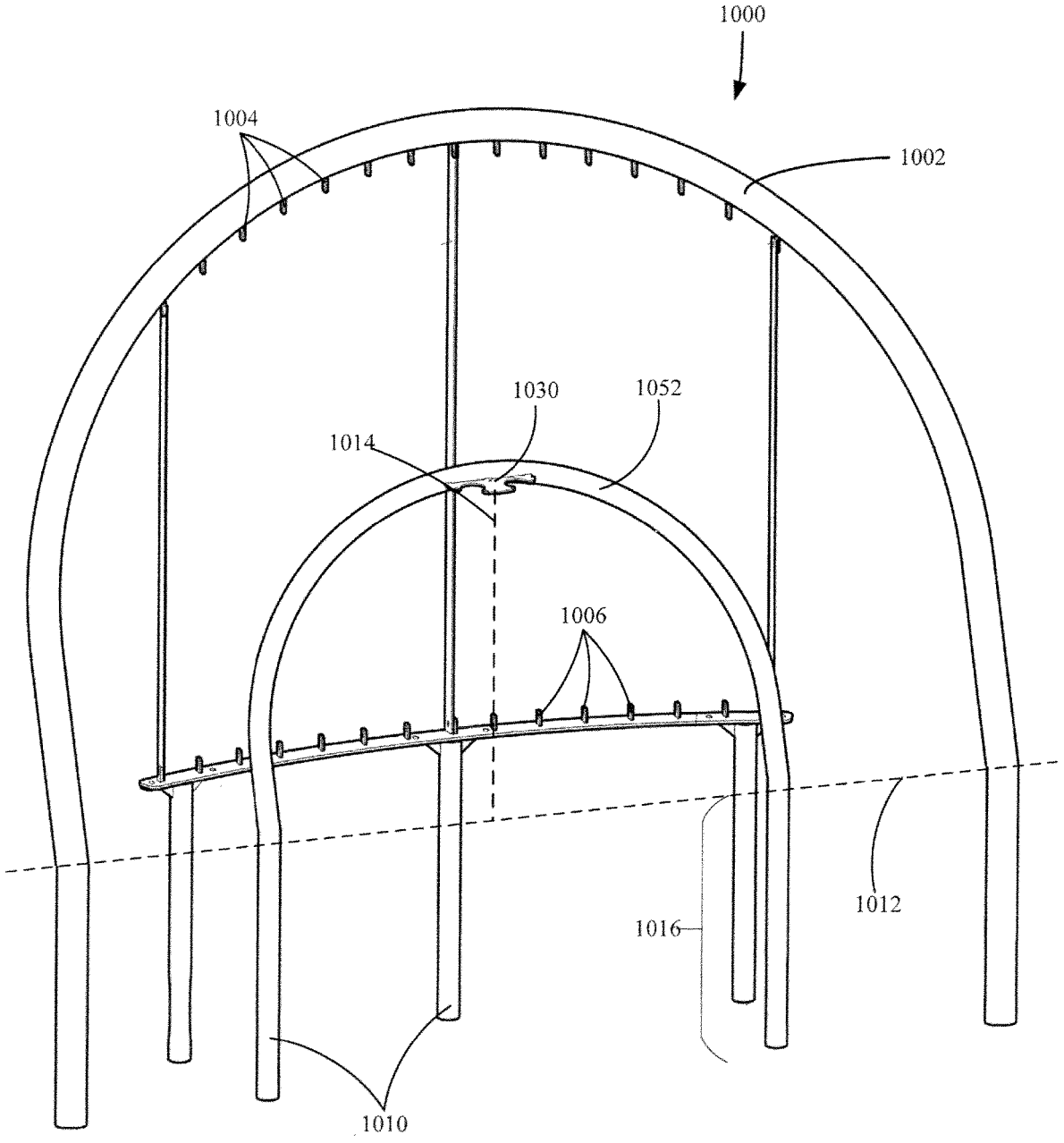
FIG. 10 illustrates a perspective view of an installed frame for a chime set in accordance with one embodiment of the present invention.

FIG. 10 illustrates a perspective view of an installed frame for a chime set in accordance with one embodiment of the present invention. Installed chimes frame 1000, in the embodiment of FIG. 10, comprises an outer frame 1002, an inner frame 1052, upper mount mechanisms 1004, lower mount mechanisms 1006 and mallet holder 1030. Outer frame 1002 and inner frame 1052 are optionally secured to the ground through the use of footing legs 1010. Height 1014, in one embodiment, is that which would allow a wheelchair easy accessibility. In one embodiment, the inner frame 1052 is located height 1014. In one embodiment, height 1014 maintains a minimum knee clearance of at least 27" above ground 1012 as recommended by the ADA for sufficient accessibility. In a partial assembled view, upper mount mechanisms 1004 and lower mount mechanisms 1006 are also clearly visible. In one embodiment, mount mechanisms 1004 and/or 1006 are flanges extending off of the outer and lower frames. In another embodiment, mount mechanisms 1004 and/or 1006 may comprise eye hooks extending from outer and lower frame, tipper mount mechanisms 1004 and lower mount mechanisms 1006 may be the same type of mounting mechanisms, in one embodiment. Upper mount mechanisms 1004 and lower mount, mechanisms 1006 may be different mounting mechanisms, in one embodiment. In another embodiment, upper mount mechanisms 1004 and lower mount mechanisms 1006 may comprise any mechanism that can anchor a cable to a base. Alternatively, in another embodiment, upper mount mechanisms 1004 and lower mount mechanisms 1006 may connect directly to the tone mechanisms (not shown) without a cable. In one embodiment, installed portion 1016 is substantially below the ground line 1012 and is the portion of installed chimes frame 1000 that secures installed chimes frame 1000.

Figure 11:
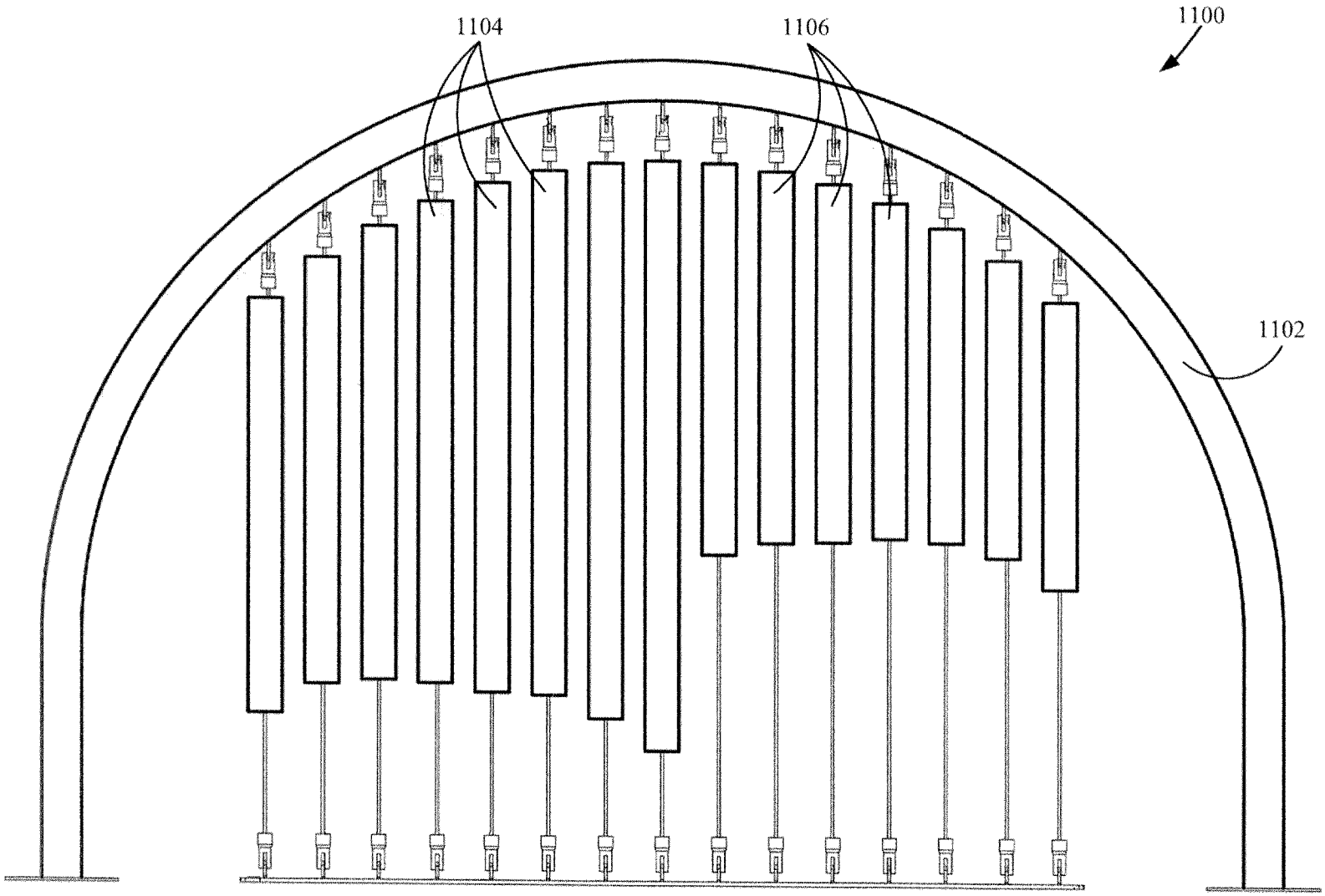
FIG. 11 illustrates a front view of a set of chimes in accordance with one embodiment of the present invention.

FIG. 11 illustrates a front view of a set of chimes in accordance with one embodiment of the present invention. Chimes 1100, in the shown embodiment, comprises a first octave 1102, a second octave 1104 and a frame 1102. In another embodiment, chimes 1100 may have more or fewer octave sets underneath frame 1102. In one embodiment, the notes may be arranged by octave and then by note. In another embodiment, the notes may be arranged out of scale for more easy access to frequently used notes.

Figure 12A:
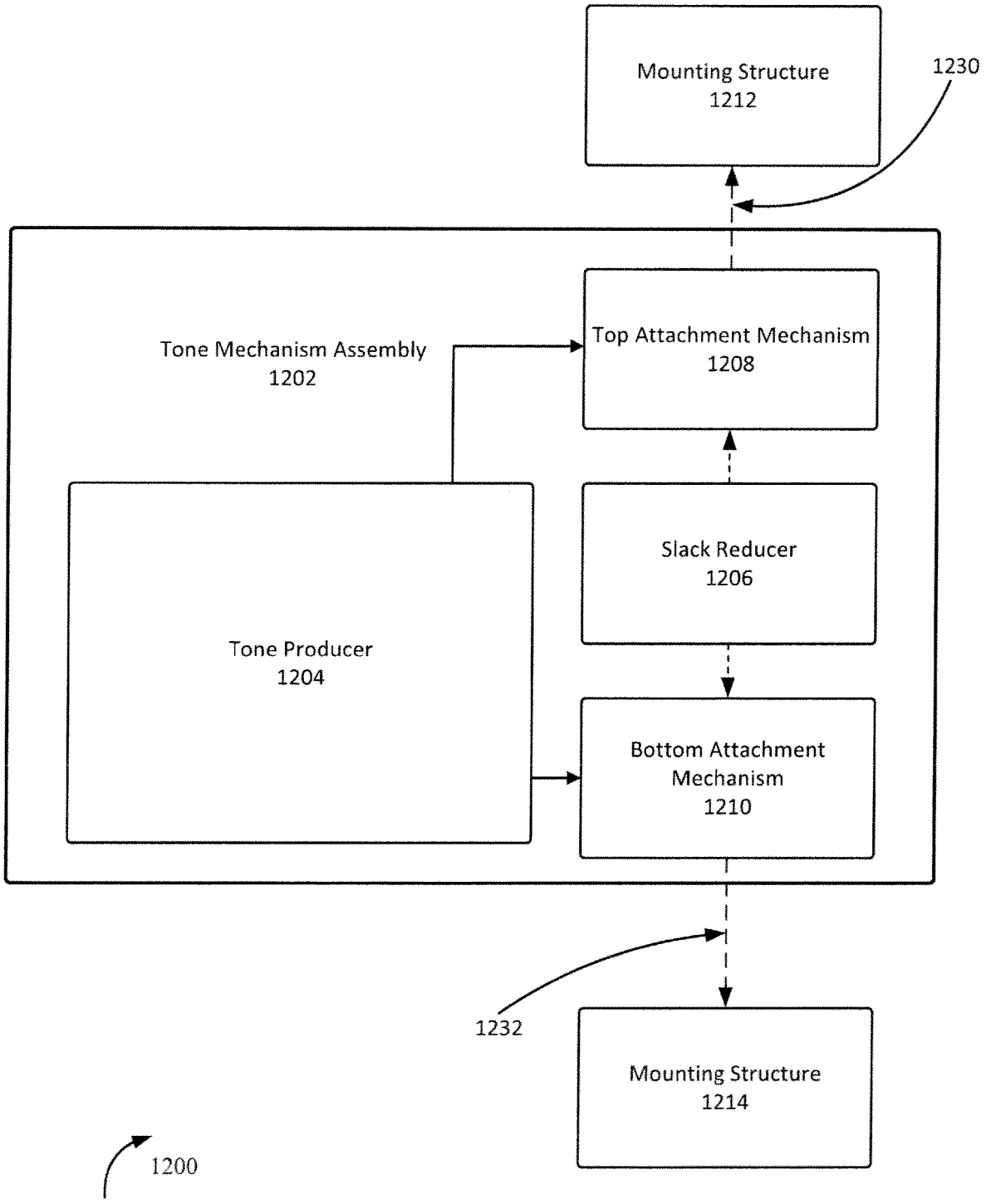
FIG. 12A illustrates a block diagram of a chime assembly in accordance with one embodiment of the present invention.

FIG. 12A illustrates a block diagram of a chime assembly in accordance with one embodiment of the present invention. Chime assembly 1200 represents one embodiment of an attachment of tone mechanism assembly 1202 to mounting structures 1212 and 1214. Tone mechanism assembly 1202, in one embodiment, comprises a top attachment mechanism 1208 and a bottom attachment mechanism 1210. Top attachment mechanism 1208, in one embodiment, attaches to mounting structure 1212 through mount 1230. Bottom attachment mechanism 1210 attaches to mounting structure 1214, in one embodiment, through mount 1232. In one embodiment, mounts 1230 and 1232 comprise cables. In another embodiment, mount 1230 and 1232 comprise rigid cables. In another embodiment mounts 1230 and 1232 comprise chains.

In one embodiment, tone mechanism assembly 1202 comprises a slack reducer 1206. In some embodiments there may be more than one slack reducer 1206, for example, a first slack reducer attached to bottom attachment mechanism 1210, and a second slack reducer attached to top attachment mechanism 1208. Slack reducer 1206, in one embodiment, comprises a drawbar spring. In one embodiment, slack reducer 1206 comprises an extension spring. In another embodiment, slack reducer 1206 comprises a part of mount 1232 and/or mount 1230. In an embodiment where slack reducer 1206 is part of mount 1232 and/or mount 1230, the function of slack reducer 1206 may be fulfilled by an elastic composition of mount 1232 and/or 1230. Slack reducer 1206, in one embodiment, provides easier installation and also ensures a good mount of tone mechanism assembly 1202 over time, for example even if mount 1232 and/or mount 1230 may change structurally after installation for example, a cable stretching over time. In one embodiment, slack reducer 1206 changes configuration over time, such that compensates for a cable length increase over time, and sound quality is maintained. It may be recognized that slack reducer 1206 is not limited to the embodiments described herein and that slack reducer 1206 may comprise any material and shape that will apply a sufficient tension force on mount 1230 or mount 1232.

Tone mechanism assembly 1200 may also comprise a tone producer 1204. Tone producer 1204 is configured to produce a desired sound. In one embodiment, tone producer 1204 comprises a tone tube. In another embodiment, tone producer 1204 comprises a tone bar. In one embodiment, tone producer 1204 comprises metal. In another embodiment, tone producer 1204 comprises plastic. It may be recognized that tone producer 1204 is not limited to the embodiments described here and that tone producer 1204 can comprise any material and shape that will produce a desired sound in an outdoor environment.

Figure 12B:
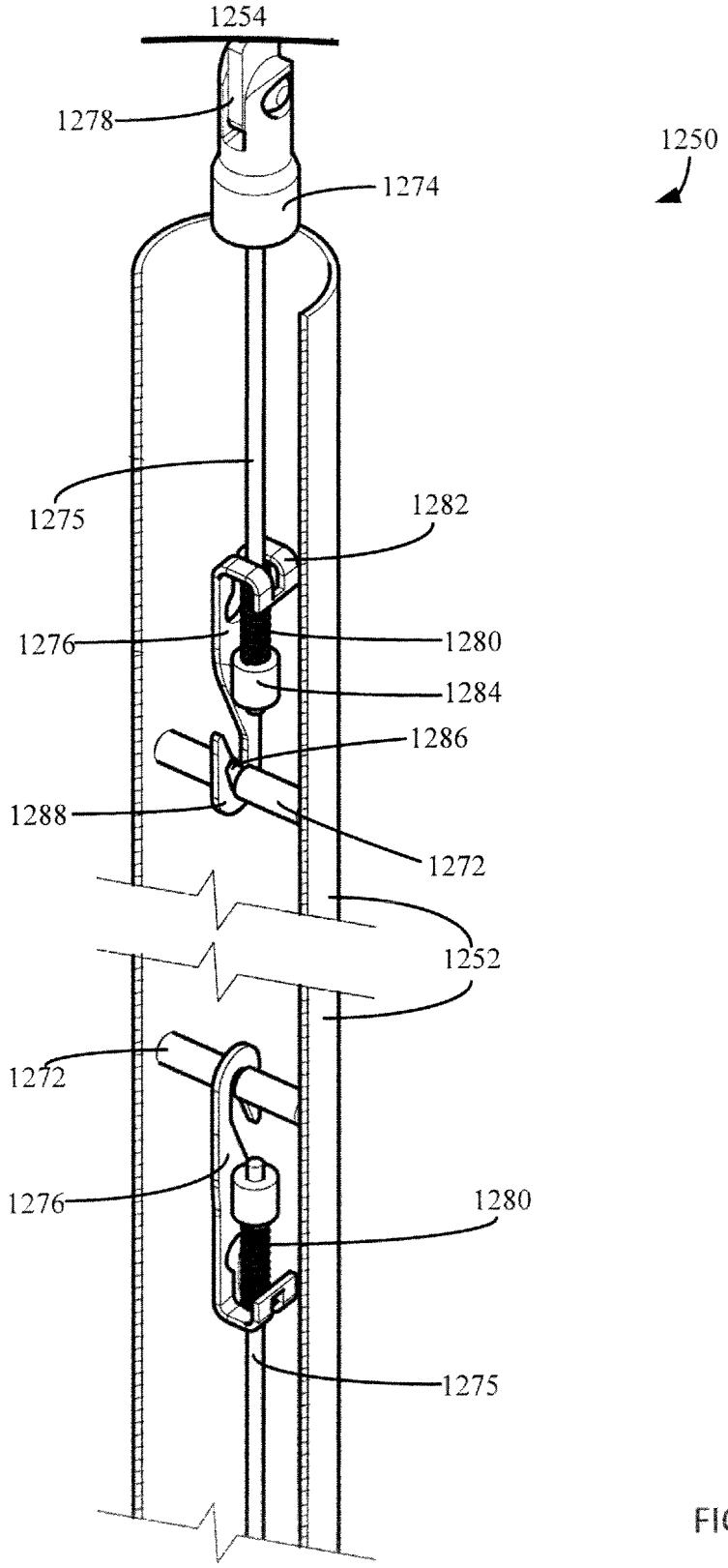
FIG. 12B illustrates a cutaway view of tone producer mounting assembly in accordance with one embodiment of the present invention.

FIG. 12B illustrates a cutaway view of tone producer mounting assembly in accordance with one embodiment of the present invention. Tone device mounting assembly 1250 comprises a frame 1254, a tone device 1252, a mounting mechanism 1278, a cable end 1274, a cable 1275, a cable attachment 1276, a slack reducer 1280 and a tone device mount 1272. In one embodiment, tone device 1302 has a tone device mount 1272 built in. In one embodiment, tone device mount 1272 is connected to cable 1275 by cable attachment 1276. In one embodiment, tone device mount 1272 is coupled to frame 1254 without the use of cables. In one embodiment, cable attachment 1276 comprises a connection feature 1288 that connects onto tone device mount 1272 at a connection point 1286. In one embodiment, cable attachment 1276 is detachable when not under tension. In another embodiment, cable attachment 1276 is a clamping device that connects to tone device mount 1272, specifically attachment mechanism 1288 connects at attachment point 1286. However, in another embodiment, cable attachment 1276 could be any device that allowed for a secure connection to tone device mount 1272.

Cable attachment 1276 optionally has a slack reducer 1280 that helps with easy installation and also ensures that there is no slack in cable 1275, which helps prevent any unwanted vibration that would affect the quality of sound produced by tone device 1252. Slack reducer 1280 is also configured, in one embodiment, to compensate for slack generated as cable 1275 ages, for example due to outdoor exposure over time. In one embodiment, slack reducer 1280, by compensating for slack in cable 1275, maintains a sound frequency of a tone producing device 1302 over its installed lifetime.

In one embodiment, slack reducer 1280 is a spring. In one embodiment slack reducer 1280 is the compression spring component of a drawbar spring, with a first drawbar end 1282 and a second drawbar end 1384. In another embodiment, slack reducer 1280 may comprise an elastic material attached to cable 1275. In another embodiment, slack reducer 1280 could be any mechanism that creates an extension force reducing slack in cable 1275.

Cable 1275, in one embodiment, is a plastic coated steel cable. However, cable 1275 may comprise, in one embodiment, any durable material. Cable 1275 comprises a cable end 1274. In one embodiment, cable end 1274 is an aluminum cylinder with a slot and a fastener inlet through which a fastener passes into mounting mechanism 1278. In another embodiment, cable end 1274 is configured to tie through an aperture of mounting mechanism 1278. In another embodiment, cable end 1274 is a looped end that attaches to a hook on mounting mechanism 1278. It may be recognized that cable end 1272 and mounting mechanism 1278 are not limited to the embodiments described herein and that cable end 1274 and mounting mechanism 1278 may be any combination that allows a secure connection between cable 1275 and frame 1254. This same configuration may be on the top and on the bottom of tone device 1252, in one embodiment. In another embodiment, the configuration on the top of tone device 1252 is different from the configuration on the bottom of tone device 1252.

Figure 13A:
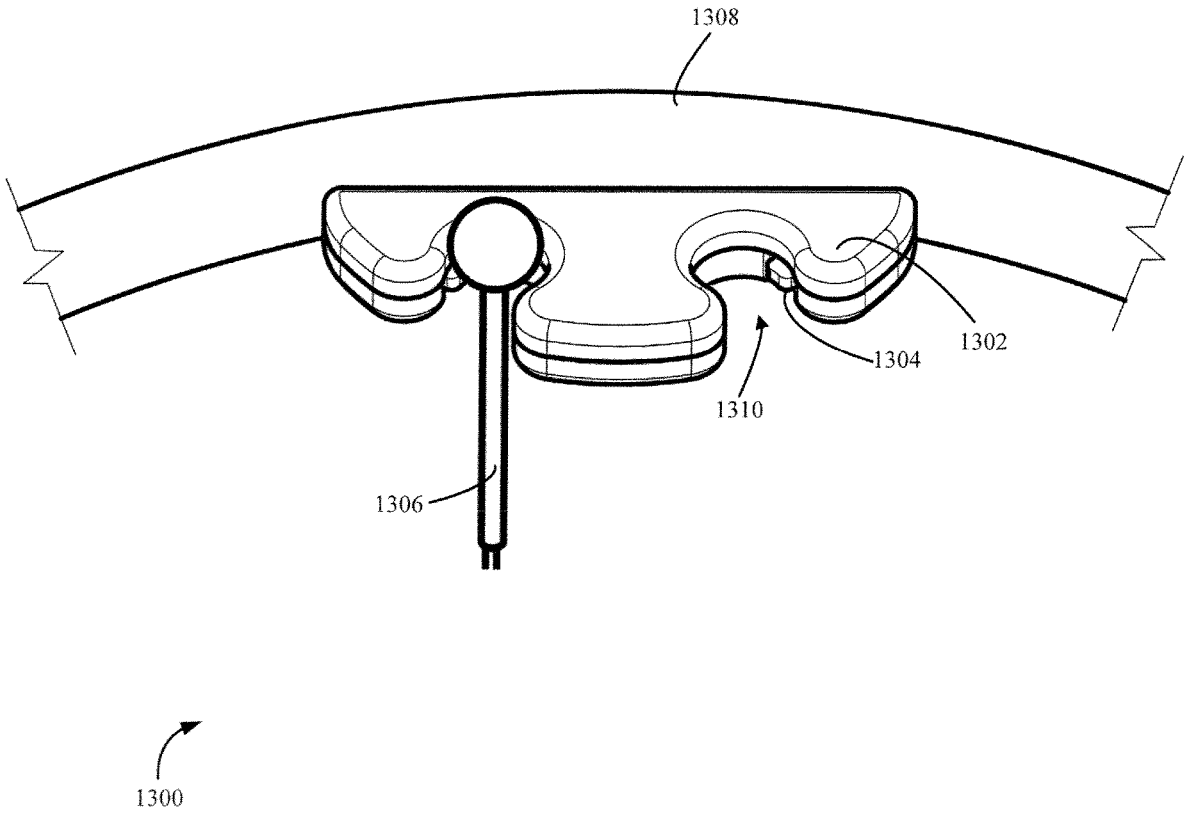
FIG. 13A illustrates an isolated view of a mallet cradle in accordance with one embodiment of the present invention.

FIG. 13A illustrates an isolated view of a mallet cradle in accordance with one embodiment of the present invention. Mallet cradle 1300 comprises a cradle base 1302, a mallet release 1304, a mallet 1306 and a frame 1308. In one embodiment, cradle base 1302 comprises an aperture 1310 configured to receive a mallet 1306. In one embodiment, within the aperture 1310 is a mallet release 1304. In one embodiment, mallet release 1304 comprises a pliable tab which mallet 1306 may rest on without displacing mallet release 1304. However, when a downward force is applied on mallet 1306, the pliable tab bends and is displaced by mallet 1306, causing mallet 1306 to fall through aperture 1310. In one embodiment, there are more than one mallet releases 1304 on cradle 1300.

In one embodiment, mallet release 1304 has a wedge shaped end. Upon application of a downward vertical force, the wedge shape of mallet release 1304 converts the downward force into horizontal force. The horizontal force then displaces mallet release 1304 and allows mallet 1306 to be released. In one embodiment, the horizontal force is opposed by a force generated by a spring.

In one embodiment, mallet release 1304 is a magnet that attracts a magnetic portion of mallet 1306, wherein the magnetic force is strong enough to support the weight of mallet 1306 but weak enough to allow a user to remove mallet 1306 from cradle base 1302. In other embodiments, different release mechanisms are also possible as mallet release 1304.

Figure 13B:
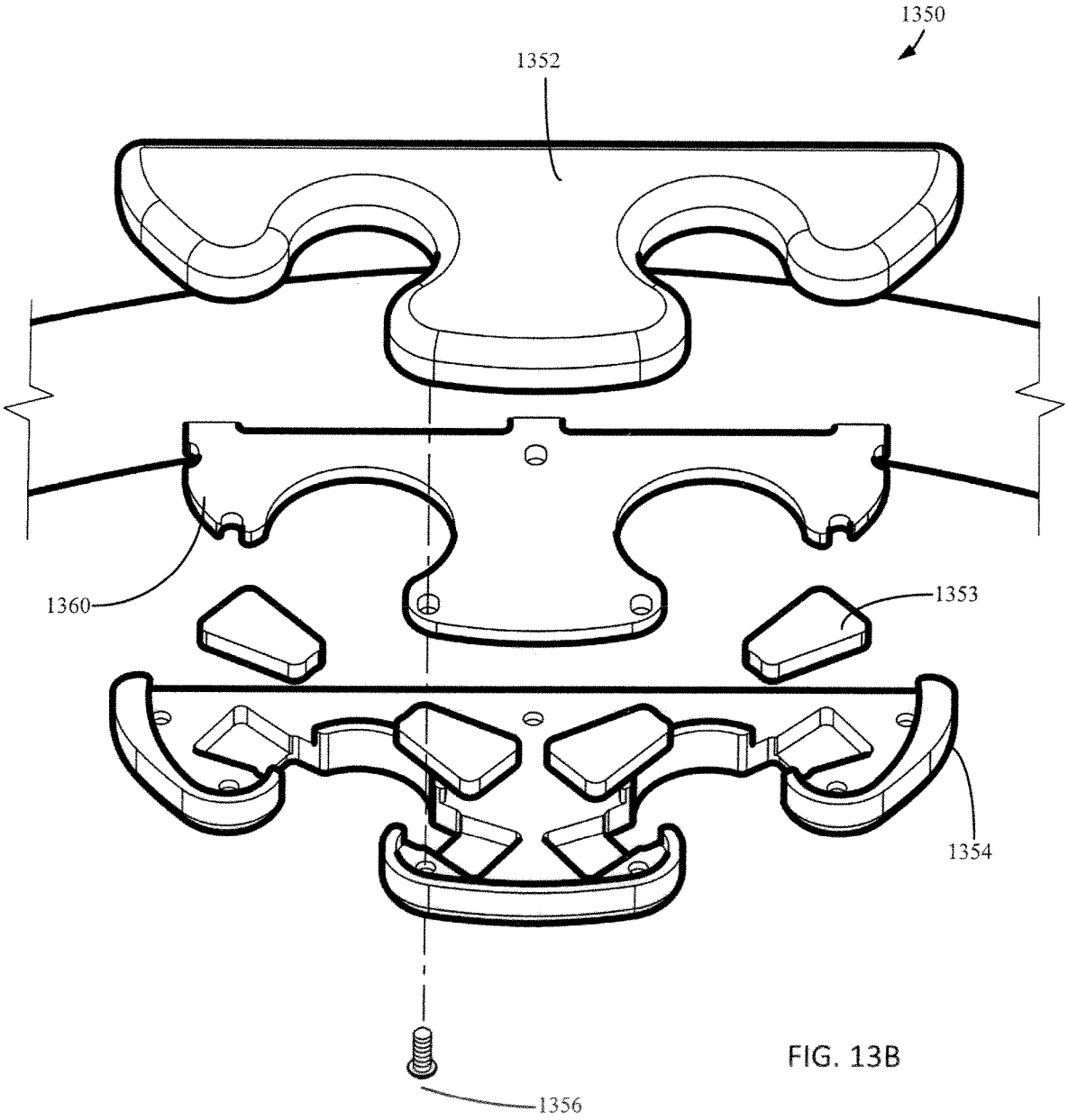
FIG. 13B illustrates an isolated exploded view of a mallet cradle in accordance with one embodiment of the present invention.

FIG. 13B illustrates an isolated exploded view of a mallet cradle in accordance with one embodiment of the present invention. Mallet cradle 1350, in the shown embodiment, comprises a cradle top 1352, a cradle bottom 1354, a mallet release 1353, cradle fasteners 1356 and a cradle mount 1360. Cradle mount 1360 is attached to base 1362, in one embodiment. In another embodiment, cradle mount 1360 is free-standing. In one embodiment, cradle mount 1360 is welded to base 1362. However, one skilled in the art would appreciate that any method of attachment of cradle mount 1360 to base 1362 could be used.

Cradle top 1352 and cradle bottom 1354 are attached to each other and cradle mount 1360 through the use of cradle fasteners 1356. Cradle fastener 1356 may be, in one embodiment, a screw. In another embodiment, cradle fastener 1356 comprises any of: a plastic weld, a bolt, or any other mechanism to secure cradle bottom to cradle top and cradle mount. In one embodiment, cradle top 1352, cradle bottom 1354 and cradle mount 1360 are one. Disposed between cradle top 1352 and cradle bottom 1354 is mallet release 1353. In one embodiment, mallet release 1353 comprises a soft or pliable material as to allow a mallet to be released with sufficient application of force. In another embodiment, mallet release 1353 comprises a spring loaded wedge. The angle of the wedge, in one embodiment, converts the vertical downward force on mallet release 1353 into horizontal force, thereby displacing mallet release 1353 and allowing the mallet to continue downward. In another embodiment mallet release 1353 could be a magnet. Cradle top 1352 and cradle bottom 1354 may, in one embodiment, be more aesthetically pleasing than cradle mount 1360 and also have smoother edges for safety reasons. Cradle top 1352 and cradle bottom 1354 may comprise a hard plastic material in one embodiment. In another embodiment, cradle bottom 1354 and cradle top 1352 comprise a soft material such as a durable foam or a durable rubber to prevent any injuries.

Figure 13C:
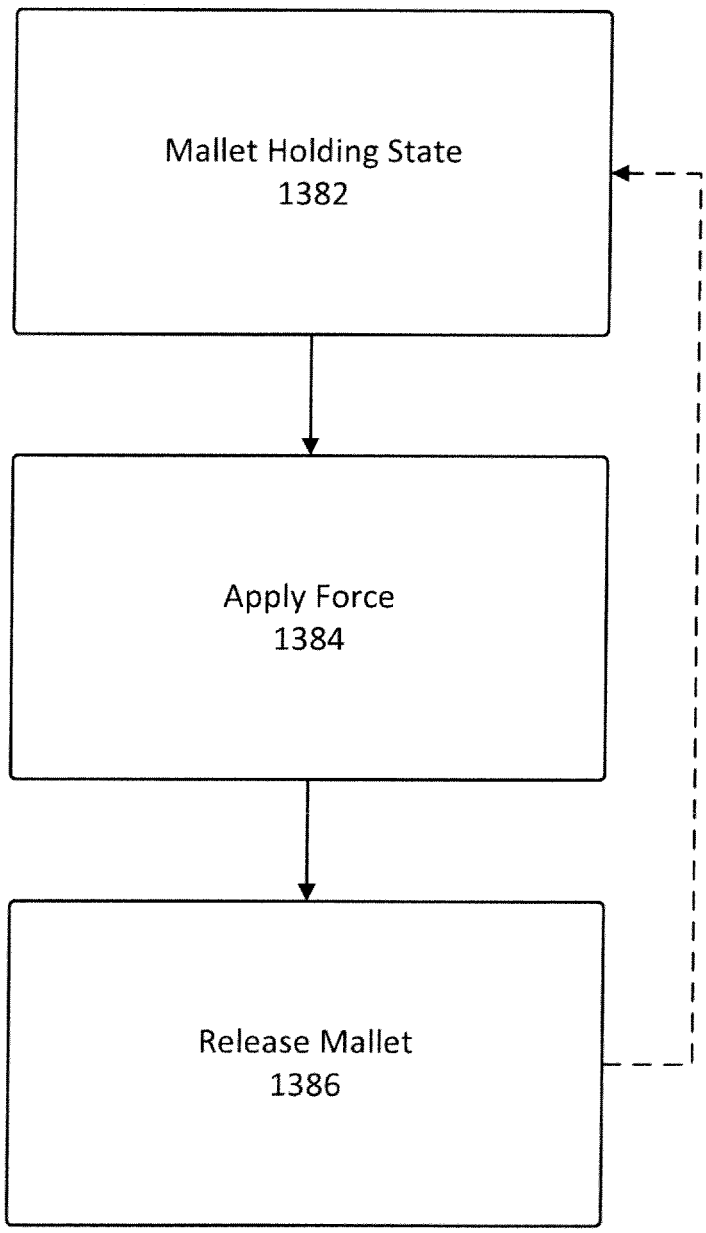
FIG. 13C illustrates a flowchart of a method of triggering a mallet release in accordance with one embodiment of the present invention.

FIG. 13C illustrates a flowchart of a method of triggering a mallet release in accordance with one embodiment of the present invention.

At block 1382 a mallet is in a mallet cradle substantially at rest. For example, mallet is at rest in an aperture of mallet cradle resting on one or more mallet releases.

At block 1384 a force is directly or indirectly applied to the mallet, for example on the cable attached to the mallet.

At block 1386, if the magnitude of the force applied is great enough the mallet is released. An exemplary force magnitude would be greater than the weight of the mallet to allow the mallet to sit at rest but less than a magnitude that could cause substantially injury to a user. Once the mallet is released it may eventually be returned to the mallet holder and the process returns to block 1382.

Figure 14A:
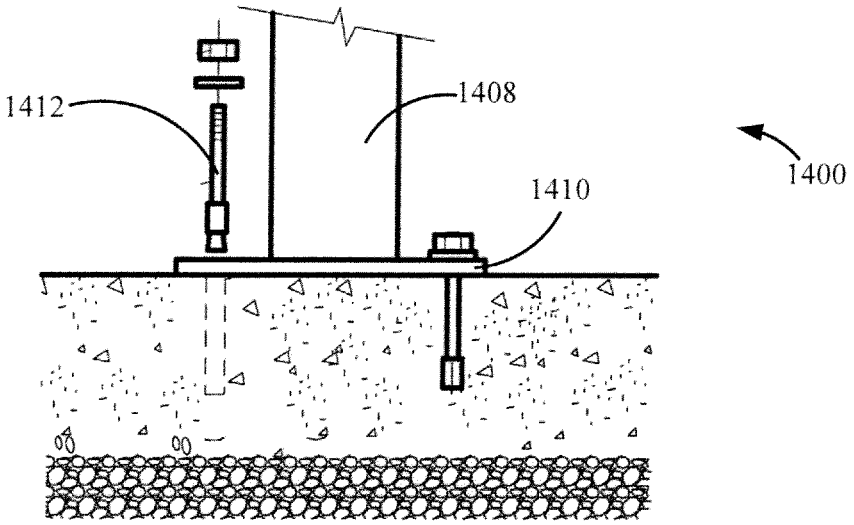
FIG. 14A illustrates a base mounting system in accordance with one embodiment of the present invention.

FIG. 14A illustrates a base mounting system. Base mounting assembly 1400, in one embodiment, comprises a fastener 1412, a base 1408 and a flange 1410. Mounting flange 1410 extends out from base 1408. Mounting flange 1410 provides a flat surface on the bottom to contact the ground and apertures there through to allow fasteners 1412 to pass through and anchor to the ground. In one embodiment, fasteners 1412 are concrete wedge anchors. In another embodiment, fasteners 1412 can be any device that could attach a flange to the ground.

Figure 14B:
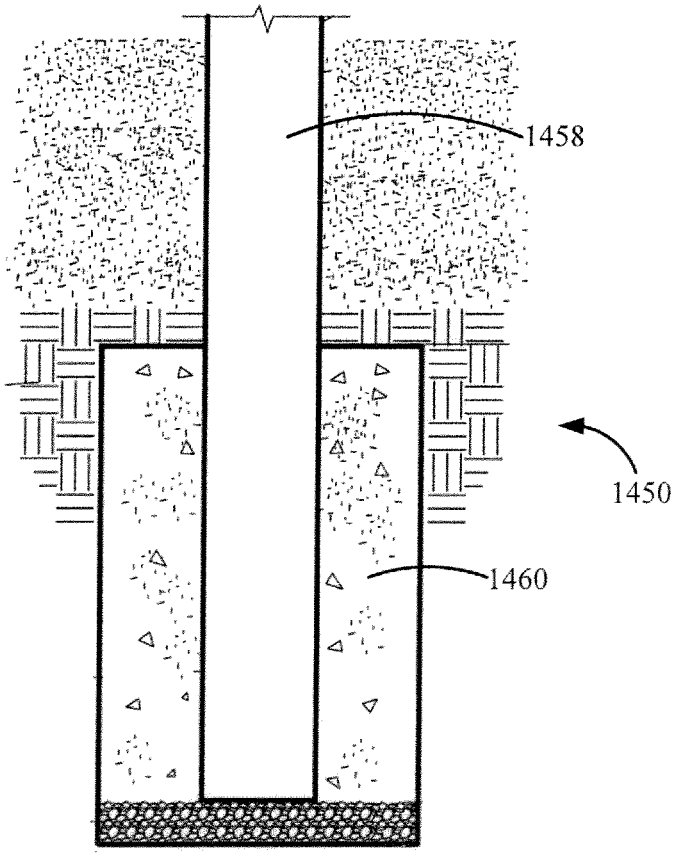
FIG. 14B illustrates a cutaway view of a mounting assembly in accordance with one embodiment of the present invention.

FIG. 14B illustrates a cutaway view of a mounting assembly. Base mounting assembly 1450, in one embodiment, comprises a base 1458 and a footing 1460. Base 1458 extends into the ground and into footing 1460. Footing 1460 may comprise concrete, in one embodiment. In another embodiment, footing 1460 is just a solid piece of ground. Footing 1460 may comprise any material so as long as base 1458 is secured to the ground with minimal movement.

Although the present invention has been described with reference to preferred embodiments, workers skilled in the art will recognize that changes may be made in form and detail without departing from the spirit and scope of the invention.

What is claimed is:

1. A chimes structure configured for permanent installation in an outdoor environment comprising:

a mounting structure; and a set of tone producing devices coupled to the mounting structure by a set of cables, wherein a first end of each cable in the set of cables is coupled to the mounting structure and a second end of each cable is fed through an end of and coupled to one of the tone producing devices.

2. The chimes structure of claim 1, wherein two cables in the set are utilized to mount a single one of the tone producing devices.

3. The chimes structure of claim 1, wherein the second end is coupled to said one of the tone producing device by way of a connection to a connect piece located inside the tone producing device.

4. The chimes structure of claim 1, wherein at least one of the cables in the set comprises a slack reducer.

5. The chimes structure of claim 1, wherein at least one of the cables in the set comprises a slack reduction spring.

6. The chimes structure of claim 1, wherein at least one of the cables in the set comprises a slack reducer hook.

7. A method of installing a chime in a permanent outdoor location, the method comprising:

coupling a first end of a cable to a frame;

coupling a chime to a second end of the cable, the second end of the cable being inserted through an end of the chime; and contracting a slack reducer such that a tension force is applied to the cable, wherein the slack reducer maintains at least a portion of the tension force.

8. The method of installing an outdoor chime of claim 7, wherein the slack reducer comprises a spring.

9. The method of installing an outdoor chime of claim 7, wherein attaching the cable to the chime comprises latching an attachment mechanism coupled to the cable onto an attachment point inside the chime.

10. The method of installing an outdoor chime of claim 7, and further comprising coupling a second cable to the chime.

11. The method of installing an outdoor chime of claim 9, wherein the attachment point comprises a groove.

12. The chimes structure of claim 5, wherein the slack reduction spring comprises a drawbar spring.

13. A chime structure configured for permanent installation in an outdoor environment comprising:

a mounting structure; and a tone producing device coupled to the mounting structure by a first cable and a second cable, wherein a first end of each of the first cable and second cable is coupled to the mounting structure and a second end of each of the first cable and second cable is fed through an end of and coupled to the tone producing device.

14. The chime structure of claim 13, wherein one of the first cable and the second cable comprises a spring and a hook.

15. The chime structure of claim 14, wherein the spring comprises a drawbar spring.

16. The chime structure of claim 15, wherein the drawbar spring comprises a compression spring that couples to a cable end on a first end and a drawbar end of the hook on a second end.

17. The chime structure of claim 14, wherein the tone producing device comprises a tone device mount configured to couple to the hook.

18. The chime structure of claim 17, wherein the tone device mount comprises a groove configured to receive the hook.

19. The chime structure of claim 18, wherein the groove is located substantially in the middle of tone device mount.

20. The chime structure of claim 13, wherein the second end of the first cable and the second cable comprises a cable end that couples to a mounting mechanism on the mounting structure using a fastener.

* * * * *